US005302501A

United States Patent [19]

Tamura et al.

[11] Patent Number: 5,302,501

[45] Date of Patent: Apr. 12, 1994

[54] SILVER HALIDE PHOTOGRAPHIC MATERIAL

[75] Inventors: Yutaka Tamura; Yasuyuki Takagi; Junichi Yamanouchi, all of Kanagawa, Japan

[73] Assignee: Fuji Photo Film Co., Ltd., Kanagawa, Japan

[21] Appl. No.: 966,383

[22] Filed: Oct. 26, 1992

[30] Foreign Application Priority Data

| | | | |
|---|---|---|---|
| Oct. 25, 1991 | [JP] | Japan | 3-305545 |
| Oct. 25, 1991 | [JP] | Japan | 3-305602 |
| Oct. 28, 1991 | [JP] | Japan | 3-307158 |
| Oct. 28, 1991 | [JP] | Japan | 3-307213 |

[51] Int. Cl.[5] ..... G03C 1/76

[52] U.S. Cl. ..... 430/537; 430/627; 430/628; 430/523; 430/539; 430/496; 430/621; 430/963

[58] Field of Search ..... 430/537, 627, 628, 523, 430/539, 496, 621, 963

[56] References Cited

U.S. PATENT DOCUMENTS

| | | | |
|---|---|---|---|
| 3,573,093 | 3/1971 | Oshibuchi et al. | 428/412 |
| 3,791,831 | 2/1974 | von Bonin et al. | 430/529 |
| 4,199,464 | 10/1978 | Sauerteig et al. | 430/451 |
| 4,414,304 | 11/1983 | Dickerson | 430/353 |
| 4,939,077 | 7/1990 | Helling et al. | 430/523 |
| 4,983,509 | 1/1991 | Inoue et al. | 430/627 |
| 5,015,562 | 5/1991 | Toya et al. | 430/518 |
| 5,028,516 | 7/1991 | Mukunoki | 430/963 |
| 5,066,572 | 11/1991 | O'Connor et al. | 430/539 |

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide photographic material comprising a support having thereon at least one silver halide emulsion layer, wherein the swelling ratio of the entire hydrophilic colloid layers on the acid polymer-containing layer side of the support of the silver halide photographic material having a hydrophilic colloid layer containing at least one acid polymer (having a carboxyl group-containing monomer unit content of at least 15 mol % or an acid value of at least 1.5 meq/g) on at least one silver halide emulsion layer-coated side thereof is at least 200% in distilled water, said acid polymer being dissolved in water and added to said hydrophilic colloid layer, and the swollen thickness of the above entire hydrophilic colloid layers at the time of the completion of the rinsing stage is not more than 8 μm when said silver halide photographic material is processed (the swelling ratio in distilled water is a value obtained by incubating the photographic material at 40° C. and 60% RH (percent relative humidity) for 16 hours, immersing it in distilled water at 21° C. for 3 minutes and measuring the change of the thickness thereof).

15 Claims, No Drawings

SILVER HALIDE PHOTOGRAPHIC MATERIAL

FIELD OF THE INVENTION

The invention relates to a silver halide photographic material and more particularly to a silver halide photographic material which is excellent in drying characteristics during processing and has a greatly improved property with regard to the formation of roller marks when processed in an automatic processor. Still more particularly, it relates to a photographic material suitable for ultra-rapid processing.

BACKGROUND OF THE INVENTION

High-temperature rapid processing has rapidly spread as a means of developing photographic materials in recent years, and the processing time thereof has been greatly shortened for various photographic materials by using automatic processors. In order to achieve rapid processing, there must be provided a developing solution capable of imparting sufficient sensitivity in a short period of time and a photographic material which is excellent in development speed and which gives a sufficient density in a short period of time. Further, the photographic material must have characteristics such that it may be dried in a short period of time after rinsing. A common method which is often used to improve the drying characteristics of photographic materials is one in which a sufficient amount of a hardening agent (e.g., gelatin crosslinking agent) is previously added during the coating stage of the photographic material and the swollen rates of the emulsion layers and hydrophilic colloid layers are lowered during the development-fixing-rinsing stage to thereby reduce the water content of the photographic material before the commencement of drying. When a large amount of a hardening agent is used in this method, the drying time can be shortened. However, since the swollen rates are lowered, there are the disadvantages that development is retarded and hence sensitivity is lowered, contrast is lowered, and covering power is lowered. Even when development progress can be improved, the retardation of the fixing rate caused by the use of a large amount of a hardening agent poses the problems of residual silver, residual hypo and residual color from sensitizing dyes. Thus, the shortening of processing time causes problems.

Methods for increasing the development activity of processing solutions are also known. The amounts of the developing agents or auxiliary developing agents in the developing solutions can be increased, the pH of the developing solutions can be increased or the processing temperature can be raised to increase development activity. However, these methods have disadvantages in that such methods damage the preservability of the developing solutions, contrast is lowered, and fogging is likely to be caused, though sensitivity can be increased.

Methods using tabular grains are described in U.S. Pat. Nos. 4,439,520 and 4,425,425 to improve the above-described disadvantages. JP-A-63-305343 (the term "JP-A" as used herein means an "unexamined published Japanese patent application") and JP-A-1-77047 disclose methods for improving development speed and the ratio of sensitivity/fog by controlling the development initiation point of silver halide grains having a (111) face to the apex of the grain and/or the edge thereof and places in the vicinity thereof. Further, JP-A-58-111933 discloses a photographic element for radiography which has a high covering power and by which one can dispense with the use of additional hardening agent during processing by making the swelling ratio of the hydrophilic colloid layer containing tabular grains 200% or lower. These known methods are excellent and of great use in the improvement of development speed of the photographic materials. However, when the processing time of the development, fixing and rinsing stages is shortened, the problems of fixing, residual silver, and residual hypo grow more and more serious, in addition to a lowering in photographic sensitivity. Further, the problem of residual color comes to the fore when photographic materials are spectrally-sensitized by sensitizing dyes. The improvement by the modification of silver halide grains has its limit except for photographic characteristics. Finally, it results in the problem of the quality of the layers. Namely, the thickness of the hydrophilic colloid layer determines fixing and residual color properties and hinders rapid processing.

In this respect, JP-A-64-73333, JP-A-64-86133, JP-A-1-105244, JP-A-1-158435 and JP-A-1-158436 disclose methods wherein the amount of gelatin in the hydrophilic colloid layer side including silver halide emulsion layers is adjusted to a value in the range of 2.00 to 3.50 $g/m^2$. This adjustment of the amount of gelatin is combined with other methods to thereby achieve ultra-rapid processing where the total processing time is from 20 seconds to less than 60 seconds. Further, JP-A-2-68537 discloses a method wherein the ratio by weight of the silver of the sensitive silver halide to the gelatin (silver/gelatin) coated on the emulsion layers is controlled to be not lower than 1.5 to thereby achieve ultra-rapid processing. Furthermore, JP-A-63-221341 discloses a method wherein silver halide grains in the emulsion layers are predominantly composed of tabular grains having a grain size of at least 5 times the thickness of grain, the amount of gelatin is controlled to 2.00 to 3.20 $g/m^2$ and the melting time is from 8 to 45 minutes to thereby achieve ultra-rapid processing where the total processing time is from 20 seconds to less than 60 seconds.

These prior art methods have been examined, and it has been found that when the amount of gelatin is reduced or the ratio of silver to gelatin is increased while the coating weight of silver is kept constant, mar blackening or roller marks seriously worsen and reach a level which is not practically acceptable. Accordingly, it has been found that photographic materials capable of being ultra-rapidly processed can not be obtained.

The term "mar blackening" as used herein refers to the phenomenon that when films are handled, films are rubbed with each other or with other materials and blackened areas in a marred form are formed after development. The term "roller marks" as used herein refers to the phenomenon that when photographic materials are processed in automatic processors, pressure is applied to the photographic materials by fine unevenness on the surface of a conveying roller and, as a result, an unevenness in density is formed in the form of black spots. When the processing time is properly divided among the development, fixing and rinsing stages in the case of rapid processing where the total processing time is set at 60 seconds or less, particularly 40 seconds or less, there is often interference with the drying characteristics of the material when automatic processors are placed under high humidity conditions unless the coating weight of gelatin is 2.5 g/m$^2$ or less. Such a reduction in the coating weight of gelatin is not acceptable from the viewpoints of mar blackening and roller marks.

Performance with regard to drying characteristics, pressure property and fixing (or residual color) can not be satisfied by controlling only the coating weight of gelatin.

It is known that polymers having an acid group (or in the form of a salt) may be used together with gelatin which is a hydrophilic colloid in photographic materials. For example, JP-B-57-53587 (the term "JP-B" as used herein means an "examined Japanese patent publication"), JP-B-57-15375, West German Patent 1,745,061, JP-B-49-23827, JP-B-55-14415, JP-B-55-15267, JP-A-48-89979, U.S. Pat. Nos. 2,279,410 and 3,791,831 and JP-B-47-28937 disclose that polymers having a carboxyl group are used to attempt to impart antistatic properties to the photographic materials. However, these patent specifications fail to disclose that the swelling ratio of the hydrophilic colloid layer is controlled by anionic high-molecular antistatic agents of this kind to expedite the drying rate of the light-sensitive materials. Generally, a large proportion of the anionic antistatic agent is used in a specific hydrophilic colloid layer, and a large amount of a hardening agent for gelatin is used to improve the physical properties of the layers. If it is intended to reduce the drying load by the control of the swelling rate after processing as in the present invention, the problems of residual silver and residual hypo are caused as described in JP-A-58-111933.

European Patents 75231 and 167081, JP-A-53-7231, JP-A-60-126674, JP-A-60-156056, JP-A-2-20861, JP-B-1-14574 and U.S. Pat. No. 4,142,894 disclose high-molecular matting agents having a carboxyl group. The matting agents primarily perform their function in such a way that the particles having a particle size of 0.2 to 10 μm are exposed to light on the surface of the photographic material, and their function is indicated by the unevenness of the surface thereof. However, such coarse particles do not sufficiently control swell characteristics after processing in the present invention.

JP-A-2-207242 discloses that a polyacrylic acid derivative may be introduced into a light-sensitive material having an antihalation layer containing a high-molecular mordant having an ammonium structure and an anionic dye to improve the decolorizability of the anionic dye. However, this patent specification does not disclose the control of swell characteristics after processing by the use of polymers having a —COOH group. Further, the present inventors having studied the patent specification and found that the acrylic acid homopolymer described in the examples thereof does not have the effect of improving drying characteristics by controlling swell characteristics after processing where substantially no hardening agent is used.

SUMMARY OF THE INVENTION

An object of the present invention is to provide a silver halide photographic material which has excellent drying characteristics, particularly in rapid processing.

Another object of the present invention is to provide a silver halide photographic material which has satisfactory drying characteristics even when the drying stage is completed in a short period of time, particularly in a roller conveying type automatic processor.

Still another object of the present invention is to provide a silver halide photographic material which is excellent in drying characteristics and has a practically acceptable level of roller marks and mar blackening.

A further object of the present invention is to provide a silver halide photographic material which meets the above-described requirements, has a high sensitivity and a high covering powder, and is excellent in rapid processability.

The above-described objects of the present invention have been achieved by:

(1) a silver halide photographic material comprising a support having thereon at least one silver halide emulsion layer and at least one hydrophilic colloid layer containing at least one carboxyl group-containing-polymer (having an acid monomer unit content of at least 15 mol % or an acid value of at least 1.5 meq/g, but excluding polyacrylic acid) on the same side of the support as the emulsion layer. The polymer has been dissolved in water and added to said hydrophilic colloid layer. The swelling ratio of all the hydrophilic colloid layers on the carboxyl group-containing-polymer-containing layer side of the support is 200% or more in distilled water, and the silver halide grains in at least one silver halide emulsion layer are tabular grains having an aspect ratio of not lower than 3.0. The swelling ratio in distilled water is the value obtained by incubating the photographic material at 40° C. and 60% RH (percent relative humidity) for 16 hours, immersing it in distilled water at 21° C. for 3 minutes, and measuring the change in the thickness thereof;

(2) a silver halide photographic material comprising a support having thereon at least one silver halide emulsion layer and at least one hydrophilic colloid layer containing at least one carboxyl group-containing-polymer (having an acid monomer unit content of at least 15 mol % or an acid value of at least 1.5 meq/g, but excluding polyacrylic acid) on the same side of the support as the emulsion layer. The polymer has been dissolved in water and added to said hydrophilic colloid layer. The swelling ratio of all the hydrophilic colloid layers on the carboxyl group-containing-polymer-containing layer side of the support is 200% or more in distilled water, and the swollen thickness of all the above hydrophilic colloid layers at the time of the completion of the rinsing stage is not more than 8 μm when said silver halide photographic material is processed. The swelling ratio in distilled water is the value obtained by incubating the photographic material at 40° C. and 60% RH (percent relative humidity) for 16 hours, immersing it in distilled water at 21° C. for 3 minutes, and measuring the change in the thickness thereof; and (3) a silver halide photographic material comprising a support having thereon at least one silver halide emulsion layer and at least one hydrophilic colloid layer containing at least one carboxyl group-containing-polymer (having an acid monomer unit content of at least 15 mol % or an acid value of at least 1.5 meq/g, but excluding polyacrylic acid) on the same side of the support as the emulsion layer. The polymer has been dissolved in water and added to said hydrophilic colloid layer. The composition of the material is such that drying is completed within a residence time of 7.5 seconds in the drying stage when said silver halide photographic material is processed in a roller conveying type automatic processor.

DETAILED DESCRIPTION OF THE INVENTION

The present invention is described in more detail below.

The carboxyl group-containing polymer of the present invention refers to a polymer which has a carboxyl group-containing monomer unit content of at least 15 mol % or an acid value of at least 1.5 meq/g (but polyacrylic acid is excluded).

The carboxyl group is sometimes referred to as the acid group below.

Examples of the carboxyl group-containing polymer which can be preferably used in the present invention include homopolymers and copolymers of ethylenically unsaturated monomers having a carboxyl group and derivatives of natural high-molecular materials.

Examples of the ethylenically unsaturated monomers having a carboxyl group include acrylic acid, methacrylic acid, maleic acid, monoalkyl esters of maleic acid (e.g., monomethyl maleate, monoethyl maleate, monobutyl maleate), itaconic acid, monoalkyl esters of itaconic acid (e.g., monoethyl itaconate), fumaric acid, monoalkyl esters of fumaric acid, crotonic acid, vinylbenzoic acid, maleic acid monoamide and itaconic acid monoamide.

These acids may be in the form of an alkali metal salt, preferably Na or K salt or an ammonium salt.

Among these monomers, acrylic acid, methacrylic acid and maleic acid are preferred in view of the solubility, transparency, lipophilicity and hydrophilicity of the resulting polymers, the affinity of the polymers with protective colloid and thier easy polymerization. Two or more of these monomers may be introduced into the polymer.

The copolymers obtained by copolymerizing the above-described acid group-containing monomers (the carboxyl group-containing monomers) with other monomers having no acid group can be used in the present invention, so long as the copolymers have an acid value of at least 1.5 meq/g or an acid group-containing monomer unit content of at least 15 mol %.

Examples of the monomers copolymerizable with the ethylenically unsaturated monomers having a carboxyl group include, but are not limited to, acrylic esters (e.g., methyl acrylate, ethyl acrylate, butyl acrylate), methacrylic esters (e.g., methyl methacrylate, ethyl methacrylate, butyl methacrylate), acrylamides (e.g., acrylamide, N-methylacrylamide, N,N-dimethylacrylamide), methacrylamides (e.g., methacrylamide), vinyl esters (e.g., vinyl acetate), vinyl ketones, allyl compounds, olefins, vinyl ethers (e.g., methyl vinyl ether), N-vinylamides, heterocyclic vinyl compounds, maleic esters, itaconic esters, fumaric esters, crotonic esters and styrene compounds (e.g., styrene, α-methylstyrene). More specifically, examples of the monomers copolymerizable with the ethylenically unsaturated monomers having a carboxyl group include methyl acrylate, ethyl acrylate, n-propyl acrylate, isopropyl acrylate, n-butyl acrylate, isobutyl acrylate, sec-butyl acrylate, amyl acrylate, hexyl acrylate, octyl acrylate, 4-chlorobutyl acrylate, cyanoethyl acrylate, dimethylaminoethyl acrylate, 2-hydroxyethyl acrylate, 3-hydroxypropyl acrylate, diethylene glycol monoacrylate, triethylene glycol monoacrylate, glycerol monoacrylate, trimethylol ethane monoacrylate, pentaerythritol monoacrylate, 2-methoxyethyl acrylate, 3-methoxybutyl acrylate, 2-(2-butoxyethoxy)-ethyl acrylate, ω-methoxypolyethylene glycol acrylate (moles of addition: n=9), 1-bromo-2-methoxyethyl acrylate, 2-hydroxy-3-chloropropyl acrylate, t-butyl acrylate, isobornyl acrylate, phenyl acrylate, p-chlorophenyl acrylate, methyl methacrylate, ethyl methacrylate, i-propyl methacrylate, t-butyl methacrylate, amyl methacrylate, N,N-diethylaminopropyl methacrylate, 2-hydroxyethyl methacrylate, diethylene glycol monomethacrylate, triethylene glycol monomethacrylate, 2-methoxyethyl methacrylate, 3-methoxybutyl methacrylate, acrylamide, methacrylamide, N-methylacrylamide, N-ethylacrylamide, N-n-propylacrylamide, N-isopropylacrylamide, N-n-butylacrylamide, N-tert-butylacrylamide, N,N-dimethylacrylamide, N,N-diethylacrylamide, hexylacrylamide, octylacrylamide, allyloxyethanol, allylbutyl ether, methyl vinyl ether, ethyl vinyl ether, propyl vinyl ether, butyl vinyl ether, allyloxyethanol, allylbutyl ether, 2-ethylbutyl vinyl ether, hydroxyethyl vinyl ether, vinyl acetate, vinyl propionate, N-vinyloxazolidone, vinylpyridine, N-vinylimidazole, N-vinyl-2-methylimidazole, N-vinyltriazole, N-vinyl-3,5-dimethyltriazole, N-vinylpyrrolidone, N-methyl-N-vinylpropioneamide, N-vinylpyrrolidone, N-vinyl-2-pyridone, ethylene, propylene, 1-butene, 1-heptene, 1-octene, dioctyl itaconate, dibutyl itaconate, dihexyl maleate, dibutyl maleate, styrene, methylstyrene, dimethylstyrene, chloromethylstyrene, chlorostyrene, methyl vinylbenzoate, vinyl chlorobenzoate, acrylonitrile, methacrylonitrile and vinyl chloride.

Among them, acrylic esters, methacrylic esters, acrylamide compounds and styrene compounds are preferred.

The carboxyl group-containing polymer is preferably one represented by formula (I):

$$-(A)_x-(B)_y- \quad (I)$$

wherein A represents a polymerized unit derived from at least one monomer represented by formula (II), and B represents a unit derived from at least one ethylenically unsaturated monomer (other than monomers represented by formula (II)) copolymerizable with A; x represents 10 to 100 mol %; and y represents 0 to 90 mol %:

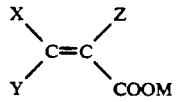

(II)

wherein X, Y and Z each represents a hydrogen atom, a substituted or unsubstituted alkyl group having 1 to 8 carbon atoms, —COOM, —$COOR_1$, —$CONR_2R_3$ or a substituted or unsubstituted phenyl group provided that at least one of X, Y and Z is a substituted or unsubstituted alkyl group having 1 to 8 carbon atoms, —$COOR_1$, —$CONR_2R_3$ or a substituted or unsubstituted phenyl group; $R_1$ represents a substituted or unsubstituted alkyl group having 1 to 18 carbon atoms, a substituted or unsubstituted aryl group having 6 to 18 carbon atoms or a substituted or unsubstituted aralkyl group having 7 to 12 carbon atoms; $R_2$ represents a hydrogen atom, a substituted or unsubstituted alkyl group having 1 to 4 carbon atoms, a substituted or unsubstituted phenyl group or a substituted or unsubstituted aralkyl group having 7 to 10 carbon atoms; $R_3$ represents $R_2$ or —$(R_4—CONH)_w—R_4—COR_5$; $R_4$ represents an aliphatic or aromatic bivalent group having 1 to 12 carbon atoms; $R_5$ represents OM or $—NR_2R_3$; M represents hydrogen atom or a cation; and w represents an integer of 0 to 6.

Among the monomers of formula (II), methacrylic acid is preferred from the viewpoint of the solubility, transparency, lipophilicity and hydrophilicity of the resulting polymers, the affinity of the resulting polymers with protective colloid and easy polymerization. Examples of the monomer for forming B include those of the above-mentioned monomers copolymerizable with the ethylenically unsaturated monomers having a carboxyl group. The preferred examples thereof include methacrylic esters, acrylic esters and styrene compounds.

With regard to the composition ratio of the polymers of formula (I) according to the present invention, a sufficient effect can be obtained by the homopolymers of the monomers of formula (II) where x is 100. Generally, the effect obtained by the polymers of formula (I) is improved with an increase in the proportion of the monomer component of formula (II). Accordingly, x is 10 to 100 mol %, preferably 20 to 80 mol %, particularly preferably 30 to 60 mol %, and y is 0 to 90 mol %, preferably 20 to 80 mol %, particularly preferably 40 to 70 mol %.

Other examples of acid polymers which can be used in the present invention include polycondensated polymers and graft polymers. These polymers may have any structure.

Examples of the derivatives of natural high-molecular materials include protein derivatives such as gelatin derivatives (e.g., maleinized gelatin, succinylated gelatin) and graft polymers of gelatin with other high-molecular materials (e.g., polyacrylic acid-grafted gelatin), cellulose derivatives (e.g., carboxymethyl cellulose), and sugar derivatives such as dextran derivatives and starch derivatives. Among them, gelatin derivatives are preferred.

Examples of the carboxyl group-containing polymers which can be used in the present invention include, but are not limited to, the following polymers, where numerals represent mol % or acid value:

| | |
|---|---|
| P-1 | Acrylic acid/methacrylic acid copolymer (20/80) |
| P-2 | Acrylic acid/methyl acrylate copolymer (40/60) |
| P-3 | Acrylic acid/methyl acrylate copolymer (80/20) |
| P-4 | Acrylic acid/butyl methacrylate copolymer (15/85) |
| P-5 | Acrylic acid/butyl methacrylate copolymer (40/60) |
| P-6 | Acrylic acid/2-hydroxyethyl acrylate copolymer (40/60) |
| P-7 | Acrylic acid/acrylamide copolymer (40/60) |
| P-8 | Acrylic acid/ethyl acrylate/methyl acrylate copolymer (40/20/40) |
| P-9 | Polymethacrylic acid |
| P-10 | Methacrylic acid/methyl methacrylate copolymer (40/60) |
| P-11 | Methacrylic acid/methyl methacrylate copolymer (60/40) |
| P-12 | Methacrylic acid/methyl methacrylate copolymer (40/60) |
| P-13 | Methacrylic acid/methyl methacrylate copolymer (20/80) |
| P-14 | Methacrylic acid/ethyl acrylate copolymer (40/60) |
| P-15 | Methacrylic acid/ethyl methacrylate copolymer (40/60) |
| P-16 | Methacrylic acid/n-propyl acrylate copolymer (40/60) |
| P-17 | Methacrylic acid/n-propyl methacrylate copolymer (40/60) |
| P-18 | Methacrylic acid/isopropyl acrylate copolymer (40/60) |
| P-19 | Methacrylic acid/isopropyl methacrylate copolymer (40/60) |

-continued

| | |
|---|---|
| P-20 | Methacrylic acid/n-butyl acrylate copolymer (15/85) |
| P-21 | Methacrylic acid/n-butyl acrylate copolymer (40/60) |
| P-22 | Methacrylic acid/n-butyl acrylate copolymer (50/50) |
| P-23 | Methacrylic acid/n-butyl acrylate copolymer (60/40) |
| P-24 | Methacrylic acid/n-butyl acrylate copolymer (80/20) |
| P-25 | Methacrylic acid/tert-butyl acrylate copolymer (40/60) |
| P-26 | Methacrylic acid/tert-butyl methacrylate copolymer (40/60) |
| P-27 | Methacrylic acid/n-hexyl acrylate copolymer (40/60) |
| P-28 | Methacrylic acid/cyclohexyl acrylate copolymer (40/60) |
| P-29 | Methacrylic acid/cyclohexyl methacrylate copolymer (40/60) |
| P-30 | Methacrylic acid/phenyl acrylate copolymer (40/60) |
| P-31 | Methacrylic acid/2-hydroxyethyl acrylate copolymer (40/60) |
| P-32 | Methacrylic acid/2-hydroxypropyl methacrylate copolymer (40/60) |
| P-33 | methacrylic acid/3-hydroxypropyl acrylate copolymer (40/60) |
| P-34 | Methacrylic acid/2-methoxyethyl acrylate copolymer (40/60) |
| P-35 | Methacrylic acid/2-butoxyethyl acrylate copolymer (40/60) |
| P-36 | Methacrylic acid/2-(2-methoxyethoxy)ethyl acrylate copolymer (40/60) |
| P-37 | Methacrylic acid/acrylamide copolymer (40/60) |
| P-38 | Methacrylic acid/N-isopropylacrylamide copolymer (40/60) |
| P-39 | Methacrylic acid/N-tert-butylacrylamide copolymer (40/60) |
| P-40 | Methacrylic acid/methyl vinyl ether copolymer (40/60) |
| P-41 | Methacrylic acid/N-vinylpyrrolidone copolymer (40/60) |
| P-42 | Methacrylic acid/styrene copolymer (40/60) |
| P-43 | Methacrylic acid/styrene copolymer (60/40) |
| P-44 | Methacrylic acid/acrylonitrile copolymer (40/60) |
| P-45 | Methacrylic acid/methyl acrylate/methyl methacrylate copolymer (40/30/30) |
| P-46 | Methacrylic acid/methyl acrylate/n-butyl acrylate copolymer (40/40/20) |
| P-47 | Methacrylic acid/methyl methacrylate/tert-butyl acrylate copolymer (40/40/20) |
| P-48 | Methacrylic acid/methyl methacrylate/cyclohexyl acrylate copolymer (40/40/20) |
| P-49 | Methacrylic acid/methyl acrylate/2-hydroxyethyl acrylate copolymer (40/40/20) |
| P-50 | Methacrylic acid/methyl acrylate/acrylamide copolymer (40/40/20) |
| P-51 | Methacrylic acid/methyl methacrylate/styrene copolymer (40/40/20) |
| P-52 | Methacrylic acid/methyl acrylate/2-hydroxy acrylate/acrylonitrile copolymer (40/40/10/10) |
| P-53 | Methacrylic acid/methyl methacrylate/tert-butyl methacrylate/2-hydroxyethyl methacrylate copolymer (40/30/20/10) |
| P-54 | Maleic acid/styrene copolymer (50/50) |
| P-55 | Maleic acid/isobutylene copolymer (50/50) |
| P-56 | Block copolymer of acrylic acid onto polyvinyl alcohol (2.0 meg) |
| P-57 | Graft polymer of acrylic acid onto polyvinyl alcohol (4.0 meg) |
| P-58 | Maleinized gelatin (1.5 meg/g) |
| P-59 | Succinyl gelatin (2.0 meg/g) |
| P-60 | Carboxymethyl cellulose (4.0 meg/g) |

These acid polymers can be synthesized by the methods described in U.K. Patent 1,211,039, JP-B-46-29195, U.K. Patent 941,395, U.S. Pat. Nos. 3,227,672, 3,290,417, 3,262,919, 3,245,932, 2,681,897 and 3,230,275, John C. Petropoulos et al., *Official Digest*, 33, 719–736 (1961) *and Synthetic High-molecular Material*, 1, 246-290, 3, 1-108, written by Toshisuke Murahashi et al. Polymerization conditions such as polymerization initiators, concentrations, polymerization temperature, and reaction time can be widely varied according to the purpose.

For example, polymerization is carried out at a temperature of generally 20° to 180° C., preferably 40° to 120° C. The polymerization reaction is carried out in the presence of 0.05 to 5% by weight (based on the total amount of the monomers) of a radical polymerization initiator. Examples of the initiator include azobis compounds, peroxides, hydroperoxides and redox catalysts. More specifically, examples of the initiator include potassium persulfate, tert-butyl peroctoate, benzoyl peroxide, isopropyl percarbonate, 2,4-dichlorobenzoyl peroxide, methyl ethyl ketone peroxide, cumene hydroperoxide, dicumyl peroxide and azobisisobutyronitrile.

In a preferred embodiment of the present invention, the acid polymers to be added to the hydrophilic colloid have a molecular weight of preferably at least $5\times10^{-3}$, particularly preferably $1\times10^{4}$ to $5\times10^{6}$, in terms of weight-average molecular weight.

The amounts of the acid polymers added vary depending on the type of the photographic materials, etc., but are in the range of preferably 0.01 to 2 g/m$^2$, more preferably 0.05 to 1 g/m$^2$, still more preferably 0.1 to 0.5 g/m$^2$.

When a silver halide photographic material has two or more hydrophilic colloid layers, the acid polymers may be added to all of the hydrophilic colloid layers, or may be added to at least one hydrophilic layer without being added to the other layers. When the acid polymers of the present invention are added to two or more hydrophilic colloid layers, the amounts of the acid polymers may vary depending on the layers.

The neutralization ratios of the acid monomers preferably used in the present invention vary depending on the type and amount of the hydrophobic monomers or the structure of the repeating unit having a carboxyl group. Accordingly, all carboxyl groups may be in the form of a salt by neutralization, or all acid residues may be in the acid form.

Basically, the neutralization ratio may be set to such a value that the acid polymers can be solubilized when a mixed solution of the acid polymer and hydrophilic colloid is prepared. Alternatively, the acid polymers may be solubilized, for example, by adding an alkali when dissolved.

The acid polymers of the present invention are dissolved in water, and the resulting aqueous solution is introduced into the photographic material when applied. It is preferred that an appropriate alkali and salt are used to dissolve the polymers. Organic solvents miscible with water may be used. Examples of the organic solvents include acetone, methanol, ethanol, acetonitrile, dimethyl sulfoxide and dimethylacetamide.

Examples of solvents for use in dissolving the polymers include water, alcohols such as ethanol and methanol, dimethylformamide, tetrahydrofuran, ethyl acetate, butyl acetate, methyl ethyl ketone, acetone, cyclohexanone and mixtures thereof. Among them, water and alcohols are preferred.

As the alkali for use in neutralization, any of alkalis capable of forming a salt with the acid polymer can be used, irrespective of the type thereof. Examples of the alkali include potassium hydroxide, sodium hydroxide, lithium hydroxide and ammonia. These alkalis may be used either alone or in combination.

Gelatin can be preferably used as a hydrophilic colloid for use in hydrophilic colloid layers containing the acid polymers of the present invention.

Examples of gelatin include lime processed gelatin, acid processed gelatin and enzyme-processed gelatin. The hydrolyzates and enzymatic hydrolyzates of gelatin can also be used.

In addition to gelatin, other hydrophilic colloid can also be preferably used. Examples of other hydrophilic colloid include natural high-molecular materials such as glucose, dextran and cellulose and various synthetic hydrophilic high-molecular materials such as homopolymers, for example, polyvinyl alcohol, polyvinyl alcohol partial acetal, poly-N-vinylpyrrolidone, polyacrylic acid, polyacrylamide, polyvinyl imidazole and polyvinyl pyrazole and copolymers thereof.

It is preferred that gelatin is used in combination with dextran having an average molecular weight of not more than 50,000 or with polyacrylamide. Methods described in JP-A-63-68837 and JP-A 63-149641 can be effectively used in the present invention.

Any gelatin such as alkali-processed gelatin, acid-processed gelatin, enzyme-processed gelatin, etc., prepared by using bones, hide, etc., of cattle, pigs, fish, etc., as starting materials can be used as the hydrophilic colloid to be mixed with the acid polymers without particular limitation. Modified gelatin such as chemically modified gelatin and grafted gelatin, enzymatically modified gelatin and vinyl monomer-grafted gelatin can be used. Gelatin may have a molecular weight of generally several thousands to several tens of thousands, without particular limitation. In addition to gelatin, there can be used proteins such as albumin and casein; cellulose derivatives such as hydroxyethyl cellulose, carboxymethyl cellulose and cellulose sulfate; sugar derivatives such as sodium alginate, dextran and starch derivatives; chitin and derivatives thereof such as chitosan and hydroxyalkyl chitosans; and synthetic hydrophilic high-molecular materials such as homopolymers, for example, polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole and copolymers thereof.

When the acid polymers of the present invention are mixed with a hydrophilic binder and then coated, the pH of coating solutions for the non-sensitive layers is preferably 6.0 to 9.0, more preferably 6.5 to 8.0, still more preferably 7.0 to 7.5, and the pH of coating solutions for the silver halide emulsion layers is preferably 5.0 to 8.0, more preferably 5.5 to 7.0, still more preferably 5.8 to 6.5.

The ratio (the polymer-containing ratio) of the acid polymer to the gelatin in the photographic material of the present invention is preferably 0.03 to 0.3, more preferably 0.05 to 0.2, still more preferably 0.10 to 0.15.

The swelling ratio of the silver halide photographic material of the present invention in distilled water is preferably at least 200%, particularly preferably 200 to 280% so that fixing is not deteriorated by rapid processing and the problem of residual color does not become worse, when the problems of residual silver and residual hypo caused by rapid processing and the problem of residual color of the photographic material spectral-sensitized by sensitizing dyes are taken into consideration.

The swelling ratio at the time of completion of development stage, the swelling ratio at the time of completion of rinsing stage and the swelling ratio in distilled water are represented by the following formulas.

Swelling ratio at the time of completion of development stage =

$$\frac{\text{Thickness of layer at the time of completion of development stage} - \text{Original thickness of layer}}{\text{Original thickness of layer}} \times 100(\%)$$

Swelling ratio at the time of completion of rinsing stage =

$$\frac{\text{Thickness of layer at the time of completion of rinsing stage} - \text{Original thickness of layer}}{\text{Original thickness of layer}} \times 100(\%)$$

Swelling ratio in distilled water =

$$\frac{\text{Thickness of layer immersed in distilled water} - \text{Original thickness of layer}}{\text{Original thickness of layer}} \times 100(\%)$$

The thickness of the layer at the time of completion of the development stage refers to the thickness of the layer after the photographic material is immersed in a developing solution at 35° C. for 8 seconds.

The thickness of the layer at the time of completion of the rinsing stage refers to the thickness of the layer after the final rinsing stage when the photographic material is continuously processed in the order of development→fixing→rinsing, under such conditions that the development stage is carried out at 35° C. for 8 seconds, the fixing stage is carried out at 35° C. for 7 seconds and the rinsing stage is carried out at 20° C. for 7 seconds. The thickness of the layer immersed in distilled water refers to the thickness of the layer after the photographic material is immersed in distilled water at 21° C. for 3 minutes. The photographic material used is one obtained by incubating a photographic material at 40° C. and 60% RH (percentage relative humidity) for 16 hours.

When the swelling ratio in each stage is determined in the present invention, the measurement of the thickness of the layer under the above conditions is made by the method described in Example 12 of U.S. Pat. No. 3,841,872 (there is used a measuring device whose measuring part is made of ceramic).

The expression "developing solution and fixing solution which do not contain substantially any hardening agent" as used herein refers to a developing solution and a fixing solution which do substantially not contain any compound called a hardening agent in the art. The concentration of the hardening agent is 100 mg or less and particularly 30 mg or less per liter. Concretely, an example of such a developing solution includes RD 10 manufactured by Fuji Photo Film Co., Ltd., and an example of such a fixing solution includes RF-10 manufactured by Fiji Photo Film Co., Ltd.

According to the present invention, the ratio of the swelling ratio at the time of completion of rinsing stage to the swelling ratio at the time of completion of development stage can be adjusted to 1.0 or less. This means that the photographic material is excellent in drying characteristics without interfering with development.

According to the present invention, the ratio of the swelling ratio at the time of completion of rinsing stage to the swelling ratio in distilled water can be adjusted to 1.0 or less. This means that the photographic material is excellent in drying characteristics without interfering with development.

The swollen thickness at the time of completion of the rinsing stage in the present invention means the difference between the thickness of the layer at the time of completion of the rinsing stage and the original thickness of the layer. The swollen thickness at the time of completion of the rinsing stage is preferably not more than 8 μm, more preferably not more than 7.5 μm, particularly preferably not more than 7 μm, to impart rapid processability. Practically, the swollen thickness at the time of completion of the rinsing stage is measured by the above-described method.

The light-sensitive material of the present invention is suitable for use in rapid processing. Dry to Dry processing time is within preferably 60 seconds, more preferably 45 seconds, still more preferably 30 seconds. This is the time between the beginning of processing and the completion of processing.

In the light-sensitive material, at least one light-sensitive silver halide emulsion layer may be provided on at least one side of the support or on each of both sides thereof.

The light-sensitive material of the present invention may be optionally provided with hydrophilic colloid layers such as preferably a protective layer in addition to the light-sensitive silver halide emulsion layer.

In the photographic material of the present invention, gelatin can be preferably used as a hydrophilic binder. Gelatin is used in a coating weight of preferably 1.5 to 4.5 g/m$^2$, particularly preferably 1.8 to 3.6 g/m$^2$ per one side, though there is no particular limitation with regard to the coating weight of gelatin.

Silver halide grains which can be preferably used in the present invention is described below.

With regard to the composition of silver halide, silver iodobromide is preferred from the viewpoint of high sensitivity.

The silver halide grains of the present invention may contain a very small amount of silver chloride which does not have an effect on photographic characteristics. However, it is preferred that silver chloride is not contained.

Any monodisperse emulsions and polydisperse emulsions can be preferably used as the emulsions in the present invention.

The silver halide emulsions of the present invention may be core/shell type monodisperse emulsions. These core/shell type emulsions are disclosed in JP-A-54-48521.

Silver halide grains in the emulsions are preferably ina platy foam. However, grains having a regular crystal form such as a cubic or octahedral form or an irregular crystal form such as a spherical or potato form may be used together with the platy form.

Silver halide grains in the emulsions are preferably tabular grains having an aspect ratio of not lower than 3, more preferably not lower than 5, still more preferably not lower than 7. The upper limit is 30 with respect to practical use.

The tabular silve halide grains can be prepared by any conventional method or a combination thereof.

The tabular silver halide grains can be easily prepared by the methods described in JP-A-58-127921, JP-A-58-113927 and JP-A-58-113928.

The aspect ratio of the tabular silver halide grains can be adjusted by controlling temperature, choosing the types and amounts of solvents and controlling the addition rate of the silver salt and halides during the growth of the grains.

It is preferred that at least 50%, preferably at least 80% (in terms of projected area) of the grains in the silver halide emulsion of the present invention is composed of tabular grains.

The grains have a mean grain size of not less than 0.4 μm, more preferably 0.5 to 2.0 μm, in terms of the diameter of a sphere having a volume equal to that of the grain. A narrowere grain size distribution is preferable.

Among the tabular silver halide grains, monodisperse hexagonal tabular grains are particularly useful grains.

The details of the structure and preparation of the monodisperse hexagonal tabular grains are described in JP-A-63-151618.

It is preferred that at least 0.5 mmol of sensitizing agents per mol of silver halide or silver halide adsorbing materials corresponding to the photographic performance stabilizing agents are allowed to coexist in chemical sensitization during the preparation of the emulsions as described in JP-A-2-68539 to utilize efficiently the effect of the present invention.

Examples of silver halide adsorbing materials known as anti-fogging agents or stabilizers include azoles (e.g., benzthiazolium salts, benzimidazolium salts, imidazoles, benzimidazoles, nitroindazoles, triazoles, benztriazoles, tetrazoles, triazines); mercapto compounds (e.g., mercaptothiazoles, mercaptobenzthiazoles, mercaptoimidazoles, mercaptobenzimidazoles, mercaptobenzoxazoles, mercaptothiadiazoles, mercaptooxadiazoles, mercaptotetrazoles, mercaptotriazoles, mercaptopyrimidines, mercaptotriazines); thio-keto compounds such as oxazolidonethione; and azaindenes (e.g., triazaindenes, tetrazaindenes (particularly 4-hydroxy substituted (1,3,3a,7)tetrazaindenes), pentazaindenes).

Other examples of the adsorbing materials include purines, nucleic acids and the high-molecular compounds described in JP-B-61-36213 and JP-A-59-90844.

Among them, azaindenes, purines and nucleic acids can be preferably used in the present invention. These compounds are used in an amount of 300 to 3,000 mg, preferably 500 to 2500 mg per mol of silver halide.

Sensitizing dyes have a preferable effect as the silver halide-absorbing materials of the present invention.

Examples of the sensitizing dyes which can be used in the present invention include cyanine dyes, merocyanine dyes, complex cyanine dyes, complex mercyanine dyes, holopolar cyanine dyes, styryl dyes, hemicyanine dyes, oxonol dyes and hemioxonol dyes.

Examples of useful sensitizing dyes which can be used in the present invention are described in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, JP-A-48-76525 and Belgian Patent 691,807. The sensitizing dyes are used in an amount of at least 300 mg, but less than 2,000 mg, preferably at least 500 mg, but less than 1,000 mg per mol of silver halide.

Examples of the sensitizing dyes which can be effectively used in the present invention include the following compounds:

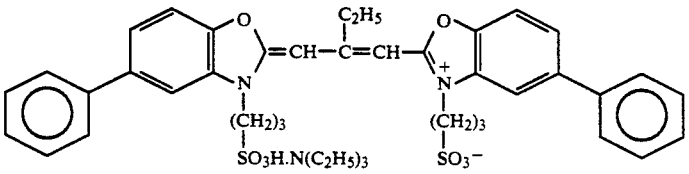

(SD-1)

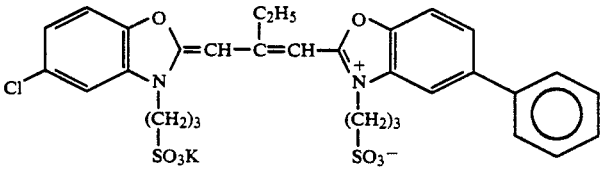

(SD-2)

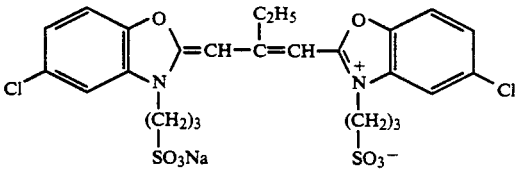

(SD-3)

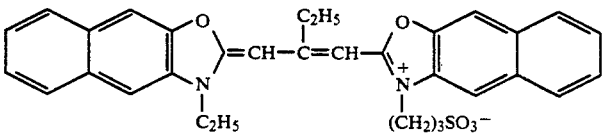

(SD-4)

-continued (SD-5)

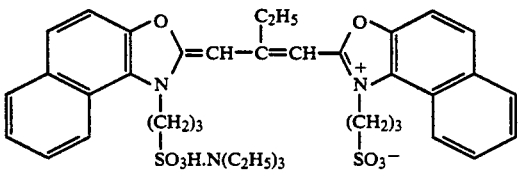

(SD-6)

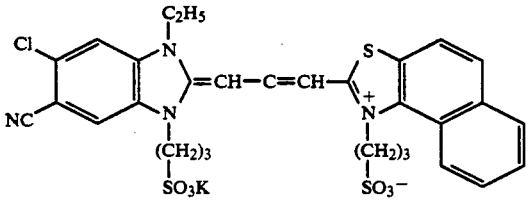

(SD-7)

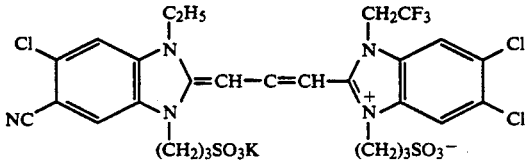

Among them, cyanine dyes are particularly preferred.

It is also preferred that the sensitizing dyes are used together with the above-described stabilizers.

The sensitizing dyes may be added at any stage after chemical sensitization, but before coating.

The chemical sensitization methods of the silver halide emulsions of the present invention include conventional methods such as a sulfur sensitization method, a selenium sensitization method, a reduction sensitization method and a gold sensitization method in the presence of the aforesaid silver halide adsorbing materials. These methods may be used either alone or in combination.

The photographic emulsions of the present invention may contain, in addition to the silver halide adsorbing materials in the chemical sensitization stage, various compounds to prevent fogging from occurring during the course of the preparation, storage or processing of the photographic materials or to stabilize photographic performance.

Examples of the compounds known as anti-fogging agents or stabilizers include azoles (e.g., benzthiazolium salts, nitroimidazoles, nitrobenzimidazoles, chlorobenzimidazoles, bromobenzimidazoles, nitroindazoles, benztriazoles, aminotriazoles); mercapto compounds (e.g., mercaptothiazoles, mercaptobenzthiazoles, mercaptobenzimidazoles, mercaptothiadiazoles, mercaptotetrazoles, mercaptopyrimidines, mercaptotriazines); thio-keto compounds such as oxazolinethione; azaindenes (e.g., triazaindenes, tetrazaindenes (particularly 4-hydroxy substituted (1,3,3a,7)tetrazaindenes), pentazaindenes); and benzenethiosulfonic acid, benzenesulfinic acid and benzenesulfonic acid amide.

There are particularly preferred nitron and derivatives thereof described in JP-A-60-76743 and JP-A-60-87322; mercapto compounds described in JP-A-60-80839; and heterocyclic compounds and complex salts of the heterocyclic compounds with silver (e.g., 1-phenyl-5-mercaptotetrazole silver). Spectral sensitizing dyes in other wavelength region may be optionally added even when the sensitizing dyes are used as the silver halide adsorbing materials in the chemical sensitization stage.

The photographic emulsion layers and other hydrophilic colloid layers of the photographic materials of the present invention may contain various surfactants as coating aids or to impart antistatic properties, improve slipperiness and emulsifying dispersion, prevent sticking, and improve photographic characteristics (e.g., development acceleration, high contrast, sensitization).

Examples of the surfactants include nonionic surfactants such as saponin (steroid), alkylene oxide derivatives (e.g., polyethylene glycol, polyethylene glycol/polypropylene glycol condensate, polyethylene glycol alkyl ethers or polyethylene glycol alkylaryl ethers, polyethylene oxide adducts of silicone) and alkyl esters of sugar; anionic surfactants such as alkylsulfonates, alkylbenzenesulfonates, alkylnaphthalenesulfonates, alkylsulfuric esters, N-acyl-N-alkyltaurines, sulfosuccinic esters and sulfoalkylpolyoxyethylene alkylphenyl ethers; ampholytic surfactants such as alkylbetaines and alkylsulfobetaines; and cationic surfactants such as aliphatic or aromatic quaternary ammonium salts, pyridinium salts and imidazolium salts.

Among them, particularly preferred are saponin; amines such as Na salt of dodecylbenzenesulfonic acid, Na salt of di-2-ethylhexyl α-sulfosuccinic acid, Na salt of p-octylphenoxyethoxyethanesulfonic acid, Na salt of dodecylsulfuric acid, Na salt of triisopropylnaphthalenesulfonic acid and Na salt of N-methyloleyltaurine; cations such as dodecyltrimethylammonium chloride, N-oleoyl-N',N',N'-trimethylammoniodiaminopropane bromide and dodecylpyridium chloride; betaines such as N-dodecyl-N,N-dimethylcarboxybetaine and N-oleyl-N,N-dimethylsulfobutylbetaine; and nonionics such as poly(average degree of polymerization: n=10)oxyethylene cetyl ether, poly(n=25)oxyethylene p-nonylphenyl ether and bis(1-poly(n=15)oxyethylene oxy-2,4-di-t-pentylphenyl)ethane.

Examples of antistatic agents which can be preferably used in the present invention include fluorine-containing surfactants such as K salt of perfluorooctanesulfonic acid, Na salt of N-propyl-N-perfluorooctanesulfonylglycine, Na salt of N-propyl-N-perfluorooctanesulfonylaminoethyloxy-poly(n=3)oxyethylenebutanesulfonic acid, N-perfluorooctanesulfonyl-N',N',N'-trimethylammoniodiaminopropane chloride and N-perfluorodecanoylaminopropyl-N',N'-dimethyl-N'-carboxybetaine; nonionic surfactants described in JP-A-60-80848, JP-A-61-112144, JP-A-62-172343 and JP-A-62-173459; alkali metal nitrates, electrically conductive tin oxide, zinc oxide, vanadium pentoxide and composite oxides obtained by doping these oxides with antimony, etc.

Examples of matting agents which can be used in the present invention include fine particles of organic compounds such as polymethyl methacrylate homopolymer, copolymer of methyl methacrylate with methacrylic acid and starch, and fine particles of inorganic compounds such as silica, titanium dioxide and strontium barium sulfate. The particle size thereof is preferably 1.0 to 10 μm, particularly preferably 2 to 5 μm.

The surface layer of the photographic material of the present invention may contain, as lubricants, silicone compounds described in U.S. Pat. Nos. 3,489,576 and 4,047,958, colloidal silica described in JP-B-56-23139, paraffin wax, higher fatty acid esters and starch derivatives.

The hydrophilic colloid layers of the photographic materials of the present invention may contain polyols such as trimethylol propane, pentanedoil, butanediol, ethylene glycol and glycerin as plasticizers.

Gelatin can be advantageously used as a binder or protective colloid for the emulsion layers, interlayers and surface protective layers of the photographic materials of the present invention. However, other hydrophilic colloids can be used.

The photographic emulsion layers and non-sensitive colloid layers of the photographic materials of the present invention may contain inorganic or organic hardening agents.

As the support of the present invention, polyethylene terephthalate film or cellulose triacetate film is preferred.

It is preferred that the surface of the support is subjected to a corona discharge treatment, a glow discharge treatment or an ultraviolet light irradiation treatment to improve adhesion between the support and the hydrophilic colloid layer. The support may be provided with an undercoat layer comprising styrenebutadiene latex or vinylidene chloride latex. A gelatin layer may be further provided on the undercoat layer.

Further, an undercoat layer may be provided by using an organic solvent containing a polyester swelling agent and gelatin. When the surfaces of these undercoat layers are treated, adhesion between the undercoat layer and the hydrophilic colloid layer can be further improved.

The emulsion layers of the photographic materials of the present invention may contain plasticizer such as polymers to improve pressure characteristics.

For example U.K. Patent 738,618 discloses a method using heterocyclic compounds; U.K. Patent 738,637 discloses a method using alkyl phthalates; U.K. Patent 738,639 discloses a method using alkyl esters; U.S. Pat. No. 2,960,404 discloses a method using polyhydric alcohols; U.S. Pat. No. 3,121,060 discloses a method using carboxyalkyl celluloses; JP-A-49-5017 discloses a method using paraffin and salts of carboxylic acids; and JP-B-53-28086 discloses a method using alkyl acrylates and organic acids.

The term "roller conveying type automatic processor" as used herein refers to a processor which has baths such as a development bath, a fixing bath, a rinsing bath, etc., and is capable of conveying automatically the photographic materials to these baths by means of rollers. After development, fixing and rinsing, the rinsing water is squeezed out of the photographic materials. That is, the photographic materials are passed through squeeze rollers and dried. Various drying methods can be used. Examples of the drying methods generally used for the automatic processor include a drying method wherein heat rollers are used, a drying method wherein hot air is blown and a drying method using an infrared heater. Methods using infrared rays can be preferably used in the present invention. Examples of the methods using infrared rays which can be used in the present invention include those described in JP-A-1-206345, JP-A-1-118840, JP-A-U-54-26734 (the term "JP-A-U" as used herein means an "unexamined published Japanese utility model application"), JP-A-U-56-130937, JP-A-1-260445, JP-A-2-140731, JP-A-2-149845, JP-A-2-157754, JP-A-U-51-52255, JP-A-U-53-53337, Japanese Patent Application Nos. 1-99193, 1-99192, 1-99191, 1-99190, 1-99189, 1 241004, 2-52967 and 2-51351. The drying temperature is preferably 40° to 80° C., though there is no particular limitation with regard to the drying temperature.

According to the present invention, the processing time taken until development, fixing, rinsing and drying stages are completed, that is, dry to dry processing time is preferably shorter than 60 seconds, more preferably 45 seconds or less, particularly preferably 30 seconds or less.

The residence time in the drying stage of the present invention refers to the residence time between the time the photographic material reaches the first rollers in the drying stage after the completion of squeezing and the time it leaves the final rollers of the automatic processor.

It is preferred in the present invention that the ratio of the swelling ratio at the time of the completion of the rinsing stage to the swelling ratio at the time of the completion of the development stage is not higher than 1.0 when processing is carried out by the sequential steps of development for 8 seconds, fixing for 7 seconds and rinsing for 7 seconds by using a developing solution containing substantially no hardening agent and a fixing solution containing substantially no hardening agent.

Furthermore, it is preferred that the ratio of the swelling ratio at the time of the completion of the rinsing stage to the swelling ratio in distilled water is not higher than 1.0 when processing is carried out by the sequential steps of development for 8 seconds, fixing for 7 seconds and rinsing for 7 seconds by using a developing solution containing substantially no hardening agent and a fixing solution containing substantially no hardening agent.

Various additives and methods described in, for example, JP-A-2-68539 can be used in the preparation and development of the photographic materials of the present invention without particular limitation. Places where the additives and the methods are described are indicated below.

| Item | Places |
|---|---|
| 1 Silver halide emulsion and the preparation thereof | From the 6th line from the bottom of right lower column of page 8 to line 12 of right upper column of page 10 of JP-A-2-68539 |
| 2 Chemical | From line 13 of right upper |

-continued

| Item | Places |
|---|---|
| sensitization method | column of page 10 to line 16 of left lower column of page 10 |
| 3 Anti-fogging agent, stabilizer | From line 117 of left lower column of page 10 to line 7 of left upper column of page 11; and from line 2 of left lower column of page 3 to left lower column of page 4 |
| 4 Spectral sensitizing dye column of page 8 | From line 4 of right lower column of page 4 to right lower |
| 5 Surfactant, antistatic agent | From line 14 of left upper column of page 11 to line 9 of left upper column of page 12 |
| 6 Matting agent, lubricant, plasticizer | From line 10 of left upper column of page 12 to line 10 of right upper column of page 12; and from line 10 of left lower column of page 14 to line 1 of right lower column of page 14 |
| 7 Hydrophilic colloid | From line 11 of right upper column of page 12 to line 16 of left lower column of page 12 |
| 8 Hardening agent | From line 17 of left lower column of page 12 to line 6 of right upper column of page 13 |
| 9 Support | From line 7 to line 20 of right upper column of page 13 |
| 10 Dye, mordant | From line 1 of left lower column of page 13 to line 9 of left lower column of page 14 |
| 11 Development method | From line 7 of right upper column of page 16 to line 15 of left lower column of page 19 of JP-A-2-103037; and from line 5 of right lower column of page 3 to line 10 of right upper column of page 6 of JP-A-2-115837 |

The present invention is now illustrated in greater detail by reference to the following examples which, however, are not to be construed as limiting the present invention in any way.

EXAMPLE 1

Preparation of octahedral grains A

To an aqueous solution of 0.35 g of potassium bromide and 20.6 g of gelatin in one liter of water kept at 50° C., there were simultaneously added 40 cc of an aqueous solution of silver nitrate (0.28 g of silver nitrate) and 40 cc of an aqueous solution of potassium bromide (0.21 g of potassium bromide) with stirring over a period of 10 minutes by means of a double jet process. Subsequently, 200 cc of an aqueous solution of silver nitrate (1.42 g of silver nitrate) and 200 cc of an aqueous solution of potassium bromide (1.06 g of potassium bromide) were simultaneously added thereto over a period of 8 minutes. Further, 27 cc of an aqueous solution of potassium bromide (2.7 g of potassium bromide) was added thereto.

Subsequently, an aqueous solution of silver nitrate and an aqueous solution of a mixture of potassium iodide and potassium bromide were added thereto by means of the controlled double jet process. The amount of the aqueous solution of silver nitrate was one liter (140 g of silver nitrate), and the aqueous solution of silver nitrate was added at such a linearly accelerating rate that the flow rate at the time of the beginning of the addition was 2 cc/min and the addition was completed in a period of 70 minutes. The aqueous solution of a mixture of potassium iodide and potassium bromide was added simultaneously with the addition of the aqueous solution of silver nitrate while the potential was controlled at a pAg of 8.58. The amount of potassium iodide consumed was 0.6 mol % based on the total amount of silver. Subsequently, 0.1 mol % (based on the total amount of silver) of an aqueous solution of 1% KI was added thereto.

The temperature of the resulting emulsion was lowered to 35° C., and soluble salts were removed by a precipitation method. The temperature of the emulsion was raised to 40° C., and 30 g of gelatin, 2.35 g of phenoxyethanol and 0.8 g of polysodium styrenesulfonate as a thickener were added thereto. The pH thereof was adjusted with sodium hydroxide to 6.0.

In this manner, monodisperse silver iodobromide octahedral Grains A having a grain size of 0.63 μm and a silver iodide content of 0.7 mol % were prepared.

A chloroaurate, sodium thiosulfate and ammonium thiocyanate were added to the Grains A, and gold-sulfur sensitization was carried out so as to give the optimum sensitivity. Subsequently, the following Sensitizing Dyes A and B in the amounts indicated below were added thereto, and the emulsion was stabilized by adding $2\times10^{-2}$ mol of 4-hydroxy-6-methyl-1,3,3a,7-tetrazaindene.

Sensitizing Dye A 590 mg/mol of Ag

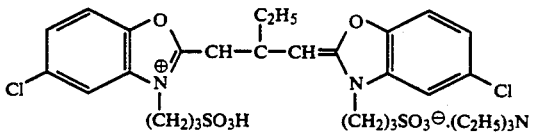

Sensitizing dye B 15 mg/mol of Ag

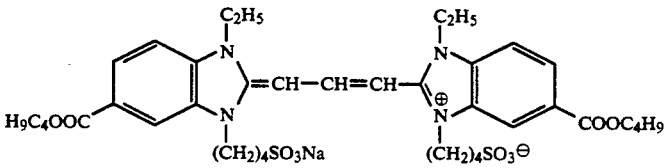

Preparation of coating solution for emulsion layer

The following reagents were added to the chemical-sensitized Emulsions A-1, A-2, A-3 and A-4 prepared above to prepare coating solutions, each amount being per mol of silver halide.

| | |
|---|---|
| 2,6-Bis(hydroxyamino)-4-diethylamino-1,3,5-triazine | 72 mg |
| Trimethylol propane | 9 g |
| Dextran (average MW = 39,000) | 18.5 g |
| Gelatin | indicated in Table 1 |
| Polymer P-3 | indicated in Table 1 |
| Polymer P-4 | indicated in Table 1 |
| Polymer P-56 | indicated in Table 1 |
| Polyacrylic acid | indicated in Table 1 |
| Hardening agent [1,2-Bis(vinylsulfonyl-acetamido)ethane] | Amount was adjusted so as to give a swelling ratio given in Table 1 |

An alkali was added to each of Polymer P-3, Polymer P-4, Polymer P-56 and polyacrylic acid to prepare a 7.5 wt. % clear aqueous solution having a pH of 7.0. The aqueous solution of each polymer was added to a coating solution for an emulsion layer. The coating solutions for the emulsion layers had a pH of 6.0.

Preparation of coating solution for surface protective layer

The coating solution for a surface protective layer was prepared so that each ingredient had the following coating weight.

| Ingredient | Coating weight |
|---|---|
| Gelatin | 1.0 g/m$^2$ |
| 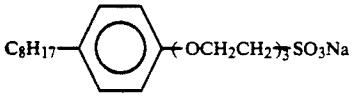 | 0.013 g/m$^2$ |
| $C_{16}H_{33}O(CH_2CH_2O)_{10}H$ | 0.45 g/m$^2$ |
| $C_{17}H_{33}CON(CH_3)CH_2CH_2SO_3Na$ | 0.0065 g/m$^2$ |
| $C_8F_{17}SO_2N(C_3H_7)(CH_2CH_2O)_{15}H$ | 0.003 g/m$^2$ |
| $C_8F_{17}SO_2N(C_3H_7)(CH_2CH_2O)_4(CH_2)_4SO_3Na$ | 0.001 g/m$^2$ |
| Polymethyl methacrylate average particle size: 3.7 μm) | 0.087 g/m$^2$ |
| Proxel (adjusted to a pH of 7.4 with NaOH) | 0.0005 g/m$^2$ |

Preparation of photographic materials

Polyethylene terephthalate of 183 μm in thickness provided with an undercoat layer containing the following dye was used as the support

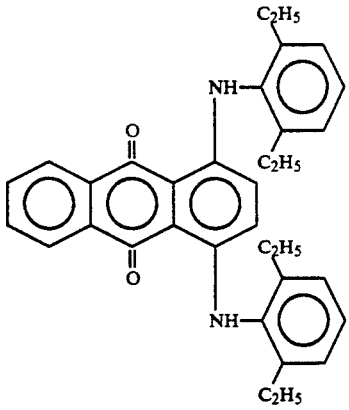

The emulsion layer and the surface protective layer were coated on both sides of the above transparent support by means of a co-extrusion method. The coating weight per one side was 1.7 g/m$^2$ in terms of silver.

Thus, the photographic materials given in Table 1 were obtained.

Evaluation of photographic performance

Photographic Materials 101 to 120 were subjected to blue exposure from both sides for 0.1 sec by using a sharp cut filter SC 52 manufactured by Fuji Photo Film Co., Ltd. After exposure, the photographic materials were processed in an automatic processor under the following conditions. The reciprocal of the exposure amount giving a density of 1.0 is referred to as sensitivity. The sensitivity in terms of the relative sensitivity is shown in Table 2 when the sensitivity of the Photographic Material 101 is referred to as 100 (standard).

Processing conditions

| | |
|---|---|
| Developing solution: | RD-10 manufactured by Fuji Photo Film Co., Ltd. |
| Fixing solution: | RF-10 manufactured by Fuji Photo Film Co., Ltd. |

The automatic processor FPM 9000 manufactured by Fuji Photo Film Co., Ltd. was modified so that the conveying speed of the film was expedited. Dry to Dry processing time was 30 seconds. Rinsing water was allowed to flow at a flow rate of 3 l/min only during the passage of the film therethrough. The flow of rinsing water was stopped when the film was not passed therethrough. The residence time in the drying stage was 7.5 seconds or less.

The replenishment of the developing solution and the fixing solution and the processing temperature were as follows.

| | Temperature | Replenisher |
|---|---|---|
| Development | 35° C. | 20 ml/10 × 12 inch |
| Fixing | 35° C. | 30 ml/10 × 12 inch |
| Rinsing | 20° C. | 3 l/min |
| Drying | 55° C. | |

Evaluation of roller marks

The Photographic Materials 101 to 120 (each having a size of 10×12 inch) were uniformly exposed to light so as to give a density of 1.0, and they were processed under the same conditions as those for the evaluation of photographic performance. In this test, rollers intentionally fatigued were used as the conveying rollers in the developing bath and cross-over rollers from development to fixing bath. The surfaces of the rollers had an unevenness of ±10 μm. After processing, many fine spots due to unevenness on the surfaces of the rollers were formed on the surfaces of the photographic materials. The formation of the spots was organoleptically evaluated in the following 4 grades. The evaluation results are shown in Table 2.

A: The formation of spots was scarcely observed.
B: Spots were slightly formed on a level which practically caused no trouble.
C: Spots were formed to such an extent that when usual rollers were used, no spot was formed (acceptable level).
D: Many spots were formed, and the films could not be put to practical use even when usual rollers were used.

Evaluation of drying characteristics

The drying characteristics of the films were organoleptically evaluated by the touch when the photographic materials (quarter size) were continuously processed under the same conditions as those for the evaluation of photographic performance.

The films were continuously processed in such a way that the short sides of the films were arranged in the conveying direction of the films. The results are shown in Table 2.

A: The 30th film left was a warm dried film. There was no trouble.
B: The 30th film left was a film which was completely dried. The temperature of the film to touch was nearly the temperature of a film which was left to stand at room temperature.
C: The 30th film left was a slightly cold film, but continuously processed films were not stuck to each other. The dried state was at an acceptable level.
D: The 30th film left was wetted and not dried. The films were stuck to each other.

Evaluation of fixing properties

Evaluation was made in the following manner. The unexposed photographic materials were processed in the automatic processor under the above-described conditions and observed while holding each film to the light of a fluorescent lamp, whereby an evaluation was made whether the fixing was completed or not. Photographic materials having a cloudy area, even a little cloudy area were evaluated as a failure in fixing. It is a matter of course that even when there is no problem in the above evaluation, a problem of image preservability due to residual silver or residual hydro is sometimes caused.

Swelling ratio and swollen thickness at the time of completion of rinsing stage

The swelling ratio of each photographic film and the swollen thickness thereof were measured according to the aforesaid measuring method by using, as the developing solution, RD-10 manufactured by Fuji Photo Film Co., Ltd. and, as fixing solution, RF-10 manufactured by Fuji Photo Film Co., Ltd.

The results are shown in Tables 1 and 2.

TABLE 1

| Photographic material | Coating weight of gelatin (per one side) ($g/m^2$) | Polymer | Coating weight of polymer ($g/m^2$) | Polymer-containing ratio | Swelling ratio in distilled water (%) | Swollen thickness at the time of completion of rinsing stage (μm) |
|---|---|---|---|---|---|---|
| 101 (Comp. Ex.) | 2.7 | | | | 180 | 7.4 |
| 102 (Comp. Ex.) | 2.7 | | | | 200 | 8.1 |
| 103 (Comp. Ex.) | 2.7 | | | | 230 | 9.2 |
| 104 (Comp. Ex.) | 2.4 | | | | 230 | 7.9 |
| 105 (Invention) | 2.16 | P-3 | 0.540 | 0.20 | 200 | 5.5 |
| 106 (Invention) | 2.16 | " | 0.540 | 0.20 | 220 | 6.3 |
| 107 (Invention) | 2.16 | " | 0.540 | 0.20 | 250 | 7.4 |
| 108 (Invention) | 2.16 | " | 0.540 | 0.20 | 280 | 8.0 |
| 109 (Invention) | 2.16 | P-4 | 0.540 | 0.20 | 200 | 5.5 |
| 110 (Invention) | 2.16 | " | 0.540 | 0.20 | 220 | 6.3 |
| 111 (Invention) | 2.16 | " | 0.540 | 0.20 | 250 | 7.4 |
| 112 (Invention) | 2.16 | " | 0.540 | 0.20 | 280 | 8.0 |
| 113 (Invention) | 2.619 | P-56 | 0.081 | 0.03 | 230 | 7.7 |
| 114 (Invention) | 2.430 | " | 0.270 | 0.10 | 230 | 7.0 |
| 115 (Invention) | 2.160 | P-56 | 0.540 | 0.20 | 230 | 6.6 |
| 116 (Invention) | 1.890 | " | 0.810 | 0.30 | 230 | 6.3 |
| 117 (Comp. Ex.) | 2.16 | polyacrylic acid | 0.540 | 0.20 | 200 | 8.1 |
| 118 (Comp. Ex.) | 2.16 | " | 0.540 | 0.20 | 220 | 8.8 |
| 119 (Comp. Ex.) | 2.16 | " | 0.540 | 0.20 | 250 | 10.1 |
| 120 (Comp. Ex.) | 2.16 | " | 0.540 | 0.20 | 280 | 11.4 |

*1.00 $g/m^2$ (per one side) in the above coating weight of gelatin is the coating weight of gelatin in the surface protective layer.

TABLE 2

| Photographic material | Sensitivity | Drying characteristics | Roller marks | Fixing properties |
|---|---|---|---|---|
| 101 (Comp. Ex.) | 100 | C | A | bad |
| 102 (Comp. Ex.) | 110 | D~C | A | bad |
| 103 (Comp. Ex.) | 120 | D | A | good |
| 104 (Comp. Ex.) | 130 | C | D | good |
| 105 (Invention) | 120 | A | A | good |
| 106 (Invention) | 130 | A | A | good |
| 107 (Invention) | 150 | C | A | good |
| 108 (Invention) | 170 | C | A | good |
| 109 (Invention) | 120 | A | A | good |
| 110 (Invention) | 130 | A | A | good |
| 111 (Invention) | 150 | C | A | good |
| 112 (Invention) | 170 | C | A | good |
| 113 (Invention) | 130 | C | A | good |
| 114 (Invention) | 130 | B | A | good |

TABLE 2-continued

| Photographic material | Sensitivity | Drying characteristics | Roller marks | Fixing properties |
|---|---|---|---|---|
| 115 (Invention) | 130 | A | A | good |
| 116 (Invention) | 130 | A | A | good |
| 117 (Comp. Ex.) | 110 | D | A | good |
| 118 (Comp. Ex.) | 120 | D | A | good |
| 119 (Comp. Ex.) | 140 | D | A | good |
| 120 (Comp. Ex.) | 160 | D | A | good |

It will be understood from Tables 1 and 2 that when the gelatin coating weight is 2.7 g/m$^2$ (Photographic Materials 101 to 103), it is impossible for both a swelling ratio in distilled water of at least 200% and a the swollen thickness of not more than 8.0 μm at the time cf completion of the rinsing stage to be simultaneously attained, that is, drying characteristics and the fixing properties cannot be simultaneously satisfied. But when the gelatin coating weight is 2.4 g/m$^2$ (Photographic Material 104), both a swelling ratio in distilled water of at least 200% and a swollen thickness of not more than 8.0 μm at the time of completion of the rinsing stage can be simultaneously attained, that is, drying characteristics and fixing properties can be simultaneously satisfied. However, the problem of roller marks becomes worse.

On the other hand, when the polymers of the present invention are used, all the drying characteristics, roller marks and fixing properties can be satisfied, and sensitivity can be greatly improved.

Further, it was found that polyacrylic acid does not improve drying characteristics (Photographic Materials 117 to 120).

EXAMPLE 2

Preparation to tabular grains

To one liter of water, there were added 4.5 g of potassium bromide, 20.6 g of gelatin and 2.5 cc of a 5% aqueous solution of thioether $HO(CH_2)_2S(CH_2)_2S(CH_2)_2OH$. To the resulting solution kept at 60° C., there were added 37 cc of an aqueous solution of silver nitrate (3.43 g of silver nitrate) and 33 cc of an aqueous solution containing 2.97 g of potassium bromide and 0.363 g of potassium iodide with stirring over a period of 37 seconds by means of a double jet process. Subsequently, an aqueous solution of 0.9 g of potassium bromide was added thereto. The temperature of the mixture was raised to 70° C., 53 cc of an aqueous solution of silver nitrate (4.90 g of silver nitrate) was added thereto over a period of 13 minutes. Further, 15 cc of a 25% aqueous solution of ammonia was added thereto. After physical ripening was carried out at that temperature for 20 minutes, 14 cc of a 100% acetic acid solution was added thereto. Subsequently, an aqueous solution of 133.3 g of silver nitrate and an aqueous solution of potassium bromide were added thereto over a period of 35 minutes by means of the controlled double jet process while keeping pAg at 8.5. Further, 10 cc of a solution of 2N potassium thiocyanate was added thereto. Physical ripening was carried out at that temperature for 5 minutes, and the temperature of the mixture was lowered to 35° C. There were obtained monodisperse tabular grains having a total silver iodide content of 0.26 mol %, a mean grain size of 1.10 μm (the diameter of the grain is defined as the diameter of a circle having an area equal to the projected area of the grain, and the average of the diameters of the grains is referred to as a mean grain size), a grain thickness of 0.157 μm and a coefficient of variation in grain size of 18.5%.

Soluble salts were removed by a precipitation method. The temperature of the emulsion was raised to 40° C., and 30 g of gelatin, 2.35 g of phenoxyethanol and 0.8 g of polysodium styrenesulfonate as a thickening agent were added thereto. The pH and the pAg of the emulsion were adjusted to 5.90 and 8.25, respectively, by using sodium hydroxide and an aqueous solution of silver nitrate.

The chemical sensitization of the emulsion was carried out while keeping the temperature thereof at 56° C. with stirring. Namely, 0.043 mg of thiourea dioxide was added and the emulsion as such was kept for 22 minutes to permit reduction sensitization. Subsequently, 20 mg of 4-hydroxy-6-methyl-1,3,3a,7-tetrazaindene and 400 mg of the following sensitizing dye were added.

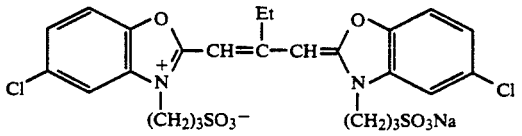

Further, 0.83 g of calcium chloride was added. Subsequently, 1.3 mg of sodium thiosulfate, 2.7 mg of the following Selenium Compound-1, 2.6 mg of chloroauric acid and 90 mg of potassium thiocyanate were added. After 40 minutes, the emulsion was cooled to 35° C. Thus, the preparation of tabular Grains T-1 was completed.

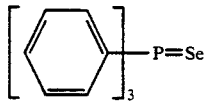

Selenium Compound-1

Preparation of coated sample

The following reagents were added to Grains T-1 to prepare coating solutions, each amount being per mol silver halide. Coated samples were prepared by using the resulting coating solutions.

| Reagent | Amount |
|---|---|
| Gelatin | indicated in Table 3 |
| Trimethylol propane | 9 g |
| Dextran (average MW = 39,000) | 18.5 g |
| 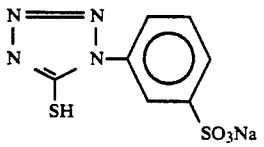 | 34 mg |
| 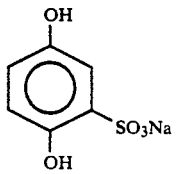 | 4.8 g |

Preparation of coating solution for surface protective layer

Coating solutions for surface protective layer were prepared so that the following ingredients gave the following coating weight.

| Ingredient | Coating weight |
|---|---|
| Gelatin | indicated in Table 3 |
| Polymer P-3 | indicated in Table 3 |
| Polymer P-23 | indicated in Table 3 |
| Polymer P-58 | indicated in Table 3 |
| Polyacrylic acid | indicated in Table 3 |
| Hardening agent [1,2-Bis(vinylsulfonyl-acetamido)ethane] | Amount was controlled so as to give a swelling ratio given Table 3 |
| 4-Hydroxy-6-methyl-1,3,3a,7-tetrazaindene | 0.015 g/m$^2$ |
| 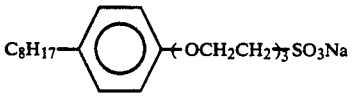 | 0.013 g/m$^2$ |
| $C_{16}H_{33}O(CH_2CH_2O)_{10}H$ | 0.045 g/m$^2$ |
| $C_{17}H_{33}CON(CH_3)CH_2CH_2SO_3Na$ | 0.0065 g/m$^2$ |
| $C_8F_{17}SO_2N(C_3H_7)(CH_2CH_2O)_{15}H$ | 0.003 g/m$^2$ |
| $C_8F_{17}SO_2N(C_3H_7)(CH_2CH_2O)_4(CH_2)_4SO_3Na$ | 0.001 g/m$^2$ |
| Polymethyl methacrylate (average particle size: 3.7 μm) | 0.087 g/m$^2$ |
| Proxel (pH was adjusted to 7.4 with NaOH) | 0.0005 g/m$^2$ |

Am alkali was added to each of Polymer P-3, Polymer P-23, Polymer P-58 and polyacrylic acid to prepare a 7.5 wt % clear aqueous solution having a pH of 7.0. The aqueous solution was added to the coating solution for a surface protective layer. The pH of the coating solution for a surface protective layer was adjusted to 7.0.

Preparation of support (1) Preparation of Dye D-1 for undercoat layer

The following dye was treated in a ball mill by the method described in JP-A 63-197943.

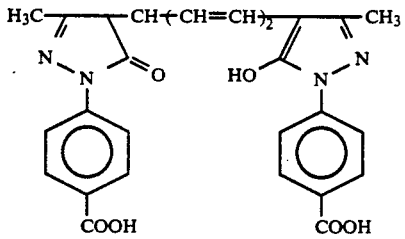

In a 2 l ball mill were placed 434 ml of water and 791 ml of a 6.7% aqueous solution of surfactant Triton X-200 (TX-200). To the resulting solution, there was added 20 g of the dye, and 400 ml of beads (2 mm diameter) of zirconium oxide (ZrO) was then added thereto. The contents were crushed for 4 days. Subsequently, 160 g of 12.5% gelatin was added thereto. After defoaming, ZrO beads were removed by filtration. The resulting dye dispersion was observed, and it was found that crushed dye particles had a wide distribution ranging from a diameter of 0.05 μm to a diameter of 1.15 μm. The average particle size was 0.37 μm. The dye particles were centrifuged to remove dye particles having a particle size of not smaller than 0.9 μm.

Thus, Dye Dispersion D-1 was obtained.

(2) Preparation of support

A biaxially oriented polyethylene terephthalate film of 183 μm in thickness was subjected to a corona discharge treatment. A first undercoating solution having the following composition was coated on the film in such an amount as to give a coating weight of 5.1 cc/m$^2$. The coating was carried out by means of a wire bar coater. The coated film was dried at 175° C. for one minute.

The first undercoat layer was also provided on other side of the film in the same manner as described above. The polyethylene terephthalate film used had an undercoat containing 0.04% by weight of the same dye as used in Example 1.

| | |
|---|---|
| Butadiene-styrene copolymer latex solution (solid content: 40%, Butadiene/styrene = 31/69 by weight) said latex solution contained 0.4 wt % (based on the amount of solid in latex) of the following compound as an emulsion dispersant | 79 cc |
| $nC_6H_{13}OOCCH_2$ / $nC_6H_{13}OOCCH-SO_3Na$ | |
| A 4% solution of sodium salt of 2,4-dichloro-6-hydroxy-s-triazine | 20.5 cc |
| Distilled water | 900.5 cc |

A second undercoat layer having the following composition was coated on the first undercoat layer of both sides of the film in such an amount as to give the following coating weight per one side. The coating was conducted by means of a wire bar coater system. The coated film was dried at 150° C.

| | |
|---|---|
| Gelatin | 160 mg/m$^2$ |
| Dye dispersion D-1 | 26 mg/m$^2$ (on a dye solid basis) |
| 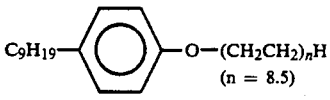 | 8 mg/m$^2$ |
| 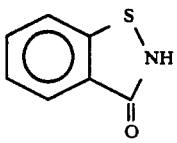 | 0.27 mg/m$^2$ |
| Matting agent (polymethyl methacrylate having an average particle size of 2.5 μm) | 2.5 mg/m$^2$ |

Preparation of photographic material

The emulsion layer and the surface protective layer were coated on both sides of the thus-prepared support by means of a co-extrusion method. The coating weight per one side was 1.75 g/m$^2$ in terms of silver. The swelling ratio was set as indicated in Table 3 by controlling the amount of gelatin added to the emulsion layer and the amount of the hardening agent. Thus, Photographic Materials 201 to 216 were obtained.

Evaluation of photographic performance

Both sides of each of Photographic Materials 101 and 201 to 220 were exposed to light for 0.5 seconds by using X-ray ortho-screen HR-4 manufactured by Fuji Photo Film Co., Ltd. to evaluate sensitivity. After exposure, the photographic materials were subjected to the following processing. The reciprocal of an exposure amount giving a density of 1.0 is referred to as sensitivity. The sensitivity in terms of relative sensitivity is shown in Table 4 when the sensitivity of Photographic Material 101 is referred to as 100 (standard).

| Processing I | |
|---|---|
| Automatic processor: | SRX-501 manufactured by Konica KK |
| Developing solution: | RD-3 manufactured by Fuji Photo Film Co., Ltd. |
| Fixing solution: | Fuji-F manufactured by Fuji Photo Film Co., Ltd. |
| Processing speed: | Dry to dry 90 seconds |
| Development temperature: | 35° C. |
| Fixing temperature: | 32° C. |
| Drying temperature: | 45° C. |
| Replenishment rate: | Developing solution: 22 ml/10 × 12 in<br>Fixing solution: 30 ml/10 × 12 in |

| Processing II | |
|---|---|
| Automatic processor: | SRX 501 manufactured by Konica KK wherein the driving motor and gear thereof are modified to expedite conveying speed |
| Developing solution: | RD-10 manufactured by Fuji Photo Film Co., Ltd. |
| Fixing solution: | RF-10 manufactured by Fuji Photo Film Co., Ltd. |
| Processing speed: | Dry to dry: 30 seconds |
| Development temperature: | 35° C. |
| Fixing temperature: | 35° C. |
| Drying temperature: | 55° C. |
| Replenishment rate: | Developing solution: 22 ml/10 × 12 in<br>Fixing solution: 30 ml/10 × 12 in |

Evalution of drying characteristics

The drying characteristics of the films were evaluated when processing II was carried out. The same criteria as in Example 1 were used.

Evaluation of roller marks

An evaluation of the photographic materials was made in the same manner as in Example 1.

Evaluation of residual color

The films with regard to residual color were evaluated when Processing II was carried out. The evaluation was made by visually comparing raw films subjected to Processing I and Processing II.

Measurement of swelling ratio and swollen thickness at the time of completion of rinsing stage The above results are shown in Tables 3 and 4.

TABLE 3

| Photographic material | Coating weight of gelatin (per one side) (g/m$^2$) | Polymer | Coating weight of polymer (g/m$^2$) | Polymer-containing ratio | Swelling ratio in distilled water (%) | Swollen thickness at the time of completion of rinsing stage (μm) |
|---|---|---|---|---|---|---|
| 201 (Comp. Ex.) | 2.7 | | | | 180 | 7.4 |
| 202 (Comp. Ex.) | 2.7 | | | | 200 | 8.1 |
| 203 (Comp. Ex.) | 2.7 | | | | 230 | 9.2 |
| 204 (Comp. Ex.) | 2.4 | | | | 230 | 7.9 |
| 205 (Invention) | 2.295 | P-3 | 0.405 | 0.15 | 200 | 5.5 |
| 206 (Invention) | 2.295 | " | 0.405 | 0.15 | 220 | 6.3 |
| 207 (Invention) | 2.295 | " | 0.405 | 0.15 | 240 | 7.0 |
| 208 (Invention) | 2.295 | " | 0.405 | 0.15 | 260 | 7.7 |
| 209 (Invention) | 2.295 | P-23 | 0.405 | 0.15 | 200 | 5.5 |
| 210 (Invention) | 2.295 | " | 0.405 | 0.15 | 220 | 6.3 |
| 211 (Invention) | 2.295 | " | 0.405 | 0.15 | 240 | 7.0 |
| 212 (Invention) | 2.295 | " | 0.405 | 0.15 | 260 | 7.7 |
| 213 (Invention) | 2.619 | P-56 | 0.081 | 0.03 | 230 | 7.7 |
| 214 (Invention) | 2.565 | " | 0.135 | 0.05 | 230 | 7.3 |
| 215 (Invention) | 2.430 | P-58 | 0.270 | 0.10 | 230 | 7.0 |
| 216 (Invention) | 2.295 | " | 0.405 | 0.15 | 230 | 6.6 |
| 217 (Comp. Ex.) | 2.295 | polyacrylic acid | 0.405 | 0.15 | 200 | 8.1 |
| 218 (Comp. Ex.) | 2.295 | " | 0.405 | 0.15 | 220 | 8.8 |
| 219 (Comp. Ex.) | 2.295 | " | 0.405 | 0.15 | 240 | 9.6 |
| 220 (Comp. Ex.) | 2.295 | " | 0.405 | 0.15 | 260 | 10.7 |

*1.70 g/m$^2$ (per side) in the above coating weight of gelatin is the coating weight of gelatin in the emulsion layer. (the coating weight of gelatin in the emulsion layer of the Photographic Material 204 is 1.4 g/m$^2$)

TABLE 4

| Photographic material | Sensitivity | | Drying characteristics | Roller marks | Residual color |
|---|---|---|---|---|---|
| | Processing [I] | Processing [II] | | | |
| 201 (Comp. Ex.) | 150 | 130 | C | A | bad |
| 202 (Comp. Ex.) | 170 | 150 | D~C | A | bad |

TABLE 4-continued

| Photographic material | Sensitivity Processing [I] | Sensitivity Processing [II] | Drying characteristics | Roller marks | Residual color |
|---|---|---|---|---|---|
| 203 (Comp. Ex.) | 190 | 170 | D | A | good |
| 204 (Comp. Ex.) | 200 | 190 | C | D | good |
| 205 (Invention) | 180 | 160 | A | A | good |
| 206 (Invention) | 190 | 170 | A | A | good |
| 207 (Invention) | 210 | 190 | B | A | good |
| 208 (Invention) | 230 | 210 | C | A | good |
| 209 (Invention) | 180 | 160 | A | A | good |
| 210 (Invention) | 190 | 170 | A | A | good |
| 211 (Invention) | 210 | 190 | B | A | good |
| 212 (Invention) | 230 | 210 | C | A | good |
| 213 (Invention) | 200 | 190 | C | A | good |
| 214 (Invention) | 200 | 190 | C | A | good |
| 215 (Invention) | 200 | 190 | B | A | good |
| 216 (Invention) | 200 | 190 | A | A | good |
| 217 (Comp. Ex.) | 170 | 150 | D | A | good |
| 218 (Comp. Ex.) | 180 | 160 | D | A | good |
| 219 (Comp. Ex.) | 200 | 180 | D | A | good |
| 220 (Comp. Ex.) | 220 | 200 | D | A | good |

It can be seen from Tables 3 and 4 that when the polymers of the present invention are used, the requirements for drying characteristics, roller marks and residual color can be satisfied without causing deterioration in photographic performance.

EXAMPLE 3

Preparation of tabular grains

To one liter of water, there were added 4.5 g of potassium bromide, 12.0 g of gelatin and 2.5 cc of a 5% aqueous solution of thioether $HO(CH_2)_2S(CH_2)_2S(CH_2)_2OH$. To the resulting solution kept at 55° C., there were added 37 cc of an aqueous solution of silver nitrate (3.43 g of silver nitrate) and 33 cc of an aqueous solution containing 2.97 g of potassium bromide and 0.363 g of potassium iodide with stirring over a period of 37 seconds by means of a double jet process. Subsequently, an aqueous solution of 0.9 g of potassium bromide was added thereto. The temperature of the mixture was raised to 70° C., and 53 cc of an aqueous solution of silver nitrate (4.90 g of silver nitrate) was added thereto over a period of 13 minutes. Further, 8 cc of a 25% aqueous solution of ammonia was added. After physical ripening was carried out at that temperature for 10 minutes, 7 cc of 100% acetic acid solution was added. Subsequently, an aqueous solution of 133.3 g of silver nitrate and an aqueous solution of potassium bromide were added thereto over a period of 35 minutes by means of the controlled double jet process while keeping pAg at 8.5. Subsequently, 10 cc of 2N potassium thiocyanate and 0.05 mol (based on the total amount of silver) of fine AgI grains having a grain size of 0.07 μm were added thereto. After physical ripening was carried out at that temperature for 5 minutes, the temperature of the mixture was lowered to 35° C. Thus, there were obtained monodisperse tabular grains having a total silver iodide content of 0.31 mol%, a mean grain size of 0.60 μm (in terms of the average diameter of projected areas), a grain thickness of 0.120 μm and a coefficient of variation in grain size of 16.5%.

Soluble salts were removed by a precipitation method. After the temperature of the emulsion was raised to 40° C., 30 g of gelatin, 2.35 g of phenoxyethanol and 0.8 g of polysodium styrenesulfonate as a thickener were added thereto. The pH and the pAg of the emulsion were adjusted to 5.90 and 7.90, respectively, by using sodium hydroxide and a silver nitrate solution.

The chemical sensitization of the emulsion was carried out while keeping it at 56° C. with stirring.

Namely, 0.043 mg of thiourea dioxide was added and the emulsion as such was held for 22 minutes to allow reduction sensitization. Subsequently, 250 mg of the same sensitizing dye as that of Example 1 was added, and sodium thiosulfate and the following selenium sensitizing agent in a ratio of 6:4 by mol were added.

Further, chloroauric acid and potassium thiocyanate were added. After 40 minutes, the temperature of the emulsion was cooled to 35° C. Thus, the preparation of tabular Grains T-2 was completed.

Preparation of coating solution for emulsion layer

The following reagents were added to the tabular Grains T-2 to prepare coating solutions for an emulsion layer, each amount being per mol of silver halide.

| | |
|---|---|
| 2,6-Bis(hydroxyamino)-4-diethylamino-1,3,5-triazine | 72 g |
| Gelatin | indicated in Table 5 |
| Polymer P-3 | indicated in Table 5 |
| Polymer P-4 | indicated in Table 5 |
| Polymer P-56 | indicated in Table 5 |
| Polyacrylic acid | indicated in Table 5 |
| Dextran (average MW = 39,000) | 18.5 g |
| 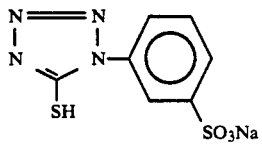 | 50 mg |

-continued

| | |
|---|---|
| 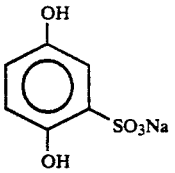 | $4 \times 10^{-2}$ mol/mol of Ag |
| 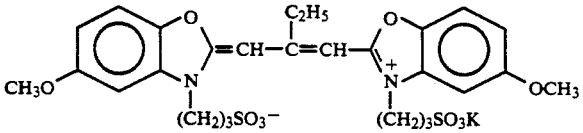 | 150 mg |
| 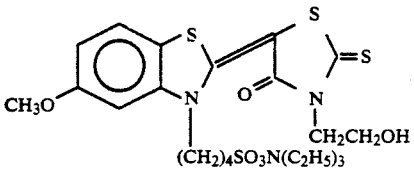 | 100 mg |
| 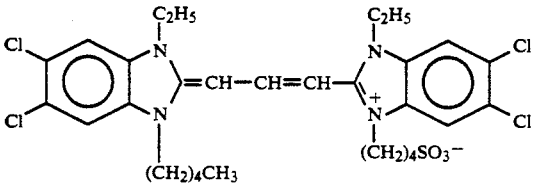 | 2.5 mg |
| Snowtex C (manufactured by Nissan Chemical Industries, Ltd.) | 9.6 g (on a solid basis) |
| Dextran (average MW = 39,000) | 5.8 g |

An alkali was added to each of Polymer P-3, Polymer P-4, Polymer P-56 and polyacrylic acid to prepare a 7.5 wt % clear aqueous solution having a pH of 7.0. The aqueous solution was added to each coating solution for an emulsion layer. The pH of the coating solutions for an emulsion layer was 6.0.

Preparation of surface protective layer

Coating solutions for surface protective layers were prepared so that each ingredient had the following coating weight. The surface protective layers were coated by using the coating solution.

| | |
|---|---|
| Gelatin | indicated in Table 5 |
| Polymer P-3 | indicated in Table 5 |
| Polymer P-4 | indicated in Table 5 |
| Polymer P-56 | indicated in Table 5 |
| Polyacrylic acid | indicated in Table 5 |
| 4-Hydroxy-6-methyl-1,3,3a,7-tetrazaindene | 0.003 g/m$^2$ |
| Polymethyl methacrylate (average particle size: 2.5 μm) | 0.05 g/m$^2$ |
| Proxel | 0.0005 g/m$^2$ |
| $C_8F_{17}SO_2N(C_3H_7)(CH_2CH_2O)_4(CH_2)_4SO_3Na$ | 0.0006 g/m$^2$ |
| $C_8F_{17}SO_2N(C_3H_7)(CH_2CH_2O)_{15}H$ | 0.0009 g/m$^2$ |
| | 35 mg/m$^2$ |

-continued

| | |
|---|---|
| 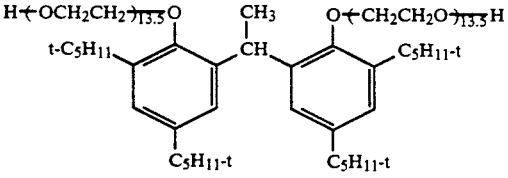 | |
| 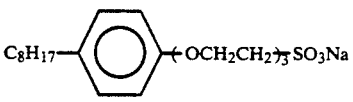 | 0.012 g/m$^2$ |
| $C_8F_{17}SO_3K$ | 0.003 g/m$^2$ |

An alkali was added to each of Polymer P-3, Polymer P-4, Polymer P-56 and polyacrylic acid to prepare a 7.5 wt % clear aqueous solution having a pH of 7.0. The aqueous solution was added to each coating solution for a surface protective layer. The coating solutions for a surface protective layer had a pH of 7.0.

The coating solution for an emulsion layer and the coating solution for a surface protective layer were coated on one side of a 183 μm thick biaxially oriented polyethylene terephthalate film having an undercoat layer by means of a co-extrusion method. The coating weight was 2.55 g/m$^2$ in terms of silver. The undercoat layer of the polyethylene terephthalate contained 0.04% by weight of the same dyes as that of Example 1.

Preparation of antihalation layer

An antihalation layer and a surface protective layer for the antihalation layer were coated on the opposite side of the support to the emulsion layer side.

Each layer had the following composition.

| Antihalation layer | |
|---|---|
| Gelatin | 1.5 g/m$^2$ |
| Phosphoric acid | 5.2 g/m$^2$ |
| Snowtex C (manufactured by Nissan Chemical Industries Ltd.) | 0.5 g/m$^2$ (on a solid basis) |
| Polypotassium styrenesulfonate (average particle size: 600,000) | 25 mg/m$^2$ |
| Polymer latex (poly(ethyl acrylate/methacrylic acid) = 97/3) | 0.53 g/m$^2$ |
| 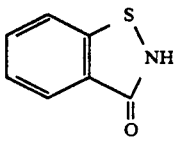 | 4.2 mg/m$^2$ |
| $CH_2{=}CHSO_2CH_2CH(OH)CH_2SO_2CH{=}CH_2$ | 40 mg/m$^2$ |
| 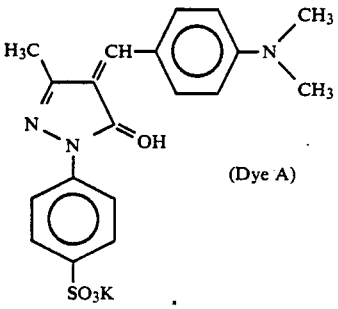 (Dye A) | 75 g/m$^2$ |
| 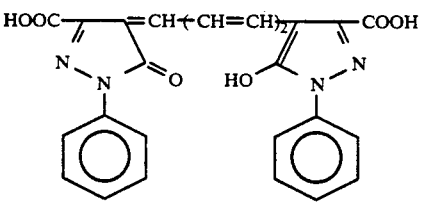 (Dye B) | 50 g/m$^2$ |

-continued

| Antihalation layer | |
|---|---|
| 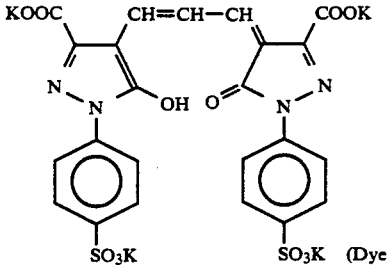 (Dye C) | 50 g/m$^2$ |

| Surface protective layer for antihalation layer | |
|---|---|
| Gelatin | 1.05 g/m$^2$ |
| Polymethyl methacrylate (average particle size: 3.5 μm) | 65 mg/m$^2$ |
| 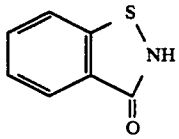 | 1.3 mg/m$^2$ |
| $C_{16}H_{33}O(CH_2CH_2O)_{10}H$ | 40 mg/m$^2$ |
| 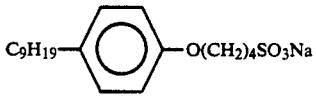 | 13 mg/m$^2$ |
| $C_8F_{17}SO_3K$ | 1.7 mg/m$^2$ |
| NaOH | 2.5 mg/m$^2$ |

The antihalation layer and the surface protective layer thereof were simultaneously coated by means of a co-extrusion method and dried.

The thus-obtained photographic materials were evaluated in the same manner as in Example 2. The results are shown in Table 6.

TABLE 5

| Photographic material | Coating weight of gelatin (per one side) g/m$^2$ | | | Polymer | Amount of polymer added g/m$^2$ | | | Polymer-containing Ratio | Swelling ratio in distilled water (%) | Swollen thickness at the time of completion of rinsing stage (μm) |
|---|---|---|---|---|---|---|---|---|---|---|
| | Emulsion layer | Protective layer | Total | | Emulsion layer | Protective layer | Total | | | |
| 301 (Comp. Ex.) | 2.0 | 1.0 | 3.0 | | | | | | 180 | 8.3 |
| 302 (Comp. Ex.) | 2.0 | 1.0 | 3.0 | | | | | | 200 | 9.1 |
| 303 (Comp. Ex.) | 2.0 | 1.0 | 3.0 | | | | | | 230 | 10.4 |
| 304 (Comp. Ex.) | 1.4 | 1.0 | 3.0 | | | | | | 230 | 7.9 |
| 305 (Invention) | 2.0 | 0.4 | 2.4 | P-3 | | 0.6 | 0.6 | 0.2 | 200 | 6.3 |
| 306 (Invention) | 1.7 | 0.7 | 2.4 | " | 0.3 | 0.3 | 0.6 | 0.2 | 200 | 6.3 |
| 307 (Invention) | 2.0 | 0.4 | 2.4 | " | | 0.6 | 0.6 | 0.2 | 240 | 7.9 |
| 308 (Invention) | 1.7 | 0.7 | 2.4 | " | 0.3 | 0.3 | 0.6 | 0.2 | 240 | 7.9 |
| 309 (Invention) | 2.0 | 0.4 | 2.4 | P-4 | | 0.6 | 0.6 | 0.2 | 200 | 6.3 |
| 310 (Invention) | 1.7 | 0.7 | 2.4 | " | 0.3 | 0.3 | 0.6 | 0.2 | 200 | 6.3 |
| 311 (Invention) | 2.0 | 0.4 | 2.4 | " | | 0.6 | 0.6 | 0.2 | 240 | 7.9 |
| 312 (Invention) | 1.7 | 0.7 | 2.4 | " | 0.3 | 0.3 | 0.6 | 0.2 | 240 | 7.9 |
| 313 (Invention) | 2.0 | 0.7 | 2.7 | P-56 | | 0.3 | 0.3 | 0.1 | 230 | 7.9 |
| 314 (Invention) | 1.85 | 0.85 | 2.7 | " | 0.15 | 0.15 | 0.3 | 0.1 | 230 | 7.9 |

TABLE 5-continued

| Photographic material | Coating weight of gelatin (per one side) g/m² Emulsion layer | Protective layer | Total | Polymer | Amount of polymer added g/m² Emulsion layer | Protective layer | Total | Polymer-containing Ratio | Swelling ratio in distilled water (%) | Swollen thickness at the time of completion of rinsing stage (μm) |
|---|---|---|---|---|---|---|---|---|---|---|
| 315 (Invention) | 2.0 | 0.4 | 2.4 | P-56 | | 0.6 | 0.6 | 0.2 | 230 | 7.5 |
| 316 (Invention) | 1.7 | 0.7 | 2.4 | " | 0.3 | 0.3 | 0.6 | 0.2 | 230 | 7.5 |
| 317 (Comp. Ex.) | 2.0 | 0.4 | 2.4 | polyacrylic acid | | 0.6 | 0.6 | 0.2 | 200 | 9.1 |
| 318 (Comp. Ex.) | 1.7 | 0.7 | 2.4 | " | 0.3 | 0.3 | 0.6 | 0.2 | 200 | 9.1 |
| 319 (Comp. Ex.) | 2.0 | 0.4 | 2.4 | " | | 0.6 | 0.6 | 0.2 | 240 | 10.8 |
| 320 (Comp. Ex.) | 1.7 | 0.7 | 2.4 | " | 0.3 | 0.3 | 0.6 | 0.2 | 240 | 10.8 |

TABLE 6

| Photographic material | Sensitivity Processing [I] | Processing [II] | Drying characteristics | Roller marks | Residual color |
|---|---|---|---|---|---|
| 301 (Comp. Ex.) | 150 | 130 | D~C | A | bad |
| 302 (Comp. Ex.) | 170 | 150 | D | A | bad |
| 303 (Comp. Ex.) | 190 | 170 | D | A | good |
| 304 (Comp. Ex.) | 200 | 180 | C | D | good |
| 305 (Invention) | 180 | 160 | A | A | good |
| 306 (Invention) | 180 | 160 | A | A | good |
| 307 (Invention) | 210 | 190 | C | A | good |
| 308 (Invention) | 210 | 190 | C | A | good |
| 309 (Invention) | 180 | 160 | A | A | good |
| 310 (Invention) | 180 | 160 | A | A | good |
| 311 (Invention) | 210 | 190 | C | A | good |
| 312 (Invention) | 210 | 190 | C | A | good |
| 313 (Invention) | 210 | 190 | C | A | good |
| 314 (Invention) | 210 | 190 | C | A | good |
| 315 (Invention) | 210 | 190 | B | A | good |
| 316 (Invention) | 210 | 190 | B | A | good |
| 317 (Comp. Ex.) | 170 | 150 | D | A | good |
| 318 (Comp. Ex.) | 170 | 150 | D | A | good |
| 319 (Comp. Ex.) | 190 | 170 | D | A | good |
| 320 (Comp. Ex.) | 190 | 170 | D | A | good |

It can be seen from Table 6 that the requirements for drying characteristics, roller marks and residual color can be satisfied without deteriorating photographic performances.

EXAMPLE 4

The procedure of Example 2 was repeated except that 1.8 g of polysodium styrenesulfonate (mol. wt.=600,000) was added in the preparation of the coated samples, and the polymers and gelatin as indicated in Table 7 were used in the preparation of the coating solutions for surface protective layer. The resulting photographic materials were evaluated in the same manner as described above. The results are shown in Table 8.

TABLE 7

| Photographic material | Coating weight of gelatin (g/m²) | Polymer | Amount of polymer added (g/m²) | Polymer-containing ratio |
|---|---|---|---|---|
| 401 (Comp. Ex.) | 2.7 | | | |
| 402 (Comp. Ex.) | 2.7 | | | |
| 403 (Comp. Ex.) | 2.7 | | | |
| 404 (Comp. Ex.) | 2.4 | | | |
| 405 (Invention) | 2.619 | P-9 | 0.081 | 0.03 |
| 406 (Invention) | 2.565 | " | 0.135 | 0.05 |
| 407 (Invention) | 2.430 | " | 0.270 | 0.10 |
| 408 (Invention) | 2.295 | " | 0.405 | 0.15 |
| 409 (Invention) | 2.619 | P-14 | 0.081 | 0.03 |
| 410 (Invention) | 2.565 | " | 0.135 | 0.05 |
| 411 (Invention) | 2.430 | " | 0.270 | 0.10 |
| 412 (Invention) | 2.295 | " | 0.405 | 0.15 |
| 413 (Comp. Ex.) | 2.619 | polyacrylic acid | 0.081 | 0.03 |
| 414 (Comp. Ex.) | 2.565 | polyacrylic acid | 0.135 | 0.05 |
| 415 (Comp. Ex.) | 2.430 | polyacrylic acid | 0.270 | 0.10 |
| 416 (Comp. Ex.) | 2.295 | polyacrylic acid | 0.405 | 0.15 |

*1.70 g/m² (per one side) in the coating weight of gelatin is the coating weight of gelatin in the emulsion layer (the coating weight of gelatin in the emulsion layer of the photographic material 404 is 1.40 g/m²)

TABLE 8

| Photographic material | Swelling ratio at the time of completion of development stage (%) | Swelling ratio in distilled water (%) | Swelling ratio at the time of completion of rinsing stage (%) | Ratio of swelling ratio at the time of completion of rinsing to swelling ratio at the time of completion of development | Ratio of swelling ratio at the time of completion of rinsing to swelling ratio in distilled water | Sensitivity Processing [I] | Sensitivity Processing [II] | Drying characteristics | Roller marks | Fixing properties |
|---|---|---|---|---|---|---|---|---|---|---|
| 401 (Comp. Ex.) | 180 | 180 | 200 | 1.11 | 1.11 | 150 | 130 | C | A | bad |
| 402 (Comp. Ex.) | 200 | 200 | 220 | 1.10 | 1.10 | 170 | 150 | D~C | A | bad |
| 403 (Comp. Ex.) | 230 | 230 | 250 | 1.09 | 1.09 | 190 | 170 | D | A | good |
| 404 (Comp. Ex.) | 230 | 230 | 250 | 1.09 | 1.09 | 200 | 190 | C | D | good |
| 405 (Invention) | 230 | 230 | 210 | 0.91 | 0.91 | 200 | 190 | C | A | good |
| 406 (Invention) | 230 | 230 | 200 | 0.87 | 0.87 | 200 | 190 | C | A | good |
| 407 (Invention) | 230 | 230 | 190 | 0.83 | 0.83 | 200 | 190 | B | A | good |
| 408 (Invention) | 230 | 230 | 180 | 0.78 | 0.78 | 200 | 190 | A | A | good |
| 409 (Invention) | 230 | 230 | 210 | 0.91 | 0.91 | 200 | 190 | C | A | good |
| 410 (Invention) | 230 | 230 | 200 | 0.87 | 0.87 | 200 | 190 | C | A | good |
| 411 (Invention) | 230 | 230 | 190 | 0.83 | 0.83 | 200 | 190 | B | A | good |
| 412 (Invention) | 240 | 230 | 180 | 0.75 | 0.78 | 210 | 200 | A | A | good |
| 413 (Comp. Ex.) | 230 | 230 | 250 | 1.09 | 1.09 | 190 | 170 | D | A | good |
| 414 (Comp. Ex.) | 230 | 230 | 250 | 1.09 | 1.09 | 190 | 170 | D | A | good |
| 415 (Comp. Ex.) | 230 | 230 | 250 | 1.09 | 1.09 | 190 | 170 | D | A | good |
| 416 (Comp. Ex.) | 230 | 230 | 250 | 1.09 | 1.09 | 190 | 170 | D | A | good |

It can be seen from Tables 7 and 8 that when the polymers of the present invention are used, the requirements for drying characteristics, roller marks and residual color can be satisfied.

EXAMPLE 5

The procedure of Example 2 was repeated except that 1.8 g of polysodium styrenesulfonate (mol. wt.=600,000) was added in the preparation of the coated samples, and the polymers and gelatin as indicated in Table 9 were used in the preparation of the coating solutions for surface protective layer. The resulting photographic materials were evaluated in the same manner as described above. The results are shown in Table 10.

TABLE 9

| Photographic material | Coating weight of gelatin (per one side) ($g/m^2$) | Polymer | Acid value (meq/g) | Coating weight of polymer ($g/m^2$) | Polymer-containing ratio | Tabular grains |
|---|---|---|---|---|---|---|
| 501 (Comp. Ex.) | 2.7 | | | | | $T_2$ |
| 502 (Comp. Ex.) | 2.7 | | | | | $T_2$ |
| 503 (Comp. Ex.) | 2.7 | | | | | $T_2$ |
| 504 (Comp. Ex.) | 2.4 | | | | | $T_2$ |
| 505 (Invention) | 2.619 | P-1 | 5.0 | 0.081 | 0.03 | $T_2$ |
| 506 (Invention) | 2.619 | " | " | 0.081 | 0.03 | $T_3$ |
| 507 (Invention) | 2.619 | " | " | 0.081 | 0.03 | $T_1$ |
| 508 (Invention) | 2.619 | " | " | 0.081 | 0.03 | $T_4$ |
| 509 (Invention) | 2.619 | " | " | 0.081 | 0.03 | $T_5$ |
| 510 (Invention) | 2.619 | P-21 | 2.0 | 0.081 | 0.03 | $T_2$ |
| 511 (Invention) | 2.619 | " | " | 0.081 | 0.03 | $T_3$ |
| 512 (Invention) | 2.619 | " | " | 0.081 | 0.03 | $T_1$ |
| 513 (Invention) | 2.619 | " | " | 0.081 | 0.03 | $T_4$ |
| 514 (Invention) | 2.619 | " | " | 0.081 | 0.03 | $T_5$ |
| 515 (Invention) | 2.619 | P-58 | 1.5 | 0.081 | 0.03 | $T_2$ |
| 516 (Invention) | 2.619 | " | " | 0.081 | 0.03 | $T_3$ |
| 517 (Invention) | 2.619 | " | " | 0.081 | 0.03 | $T_1$ |
| 518 (Invention) | 2.619 | " | " | 0.081 | 0.03 | $T_4$ |
| 519 (Invention) | 2.619 | " | " | 0.081 | 0.03 | $T_5$ |
| 520 (Comp. Ex.) | 2.619 | polyacrylic acid | 5.5 | 0.081 | 0.03 | $T_2$ |
| 521 (Comp. Ex.) | 2.619 | " | " | 0.081 | 0.03 | $T_3$ |
| 522 (Comp. Ex.) | 2.619 | " | " | 0.081 | 0.03 | $T_1$ |
| 523 (Comp. Ex.) | 2.619 | " | " | 0.081 | 0.03 | $T_4$ |

TABLE 9-continued

| 524 (Comp. Ex.) | 2.619 | " | " | 0.081 | 0.03 | $T_5$ |
|---|---|---|---|---|---|---|
| Photographic material | Aspect ratio | Swelling ratio at the time of completion of development stage | Swelling ratio in distilled water | Swelling ratio at the time of completion of rinsing stage | Ratio of swelling ratio at the time of completion of rinsing to swelling ratio at the time of completion of development | Ratio of swelling ratio at the time of completion of rinsing to swelling ratio of distilled water |
| 501 (Comp. Ex.) | 3.0 | 180 | 180 | 200 | 1.11 | 1.11 |
| 502 (Comp. Ex.) | 3.0 | 200 | 200 | 220 | 1.10 | 1.10 |
| 503 (Comp. Ex.) | 3.0 | 230 | 230 | 250 | 1.09 | 1.09 |
| 504 (Comp. Ex.) | 3.0 | 230 | 230 | 250 | 1.09 | 1.09 |
| 505 (Invention) | 3.0 | 230 | 230 | 210 | 0.91 | 0.91 |
| 506 (Invention) | 5.0 | 230 | 230 | 210 | 0.91 | 0.91 |
| 507 (Invention) | 7.0 | 230 | 230 | 210 | 0.91 | 0.91 |
| 508 (Invention) | 9.0 | 230 | 230 | 210 | 0.91 | 0.91 |
| 509 (Invention) | 12.0 | 230 | 230 | 210 | 0.91 | 0.91 |
| 510 (Invention) | 3.0 | 230 | 230 | 210 | 0.91 | 0.91 |
| 511 (Invention) | 5.0 | 230 | 230 | 210 | 0.91 | 0.91 |
| 512 (Invention) | 7.0 | 230 | 230 | 210 | 0.91 | 0.91 |
| 513 (Invention) | 9.0 | 230 | 230 | 210 | 0.91 | 0.91 |
| 514 (Invention) | 12.0 | 230 | 230 | 210 | 0.91 | 0.91 |
| 515 (Invention) | 3.0 | 230 | 230 | 210 | 0.91 | 0.91 |
| 516 (Invention) | 5.0 | 230 | 230 | 210 | 0.91 | 0.91 |
| 517 (Invention) | 7.0 | 230 | 230 | 210 | 0.91 | 0.91 |
| 518 (Invention) | 9.0 | 230 | 230 | 210 | 0.91 | 0.91 |
| 519 (Invention) | 12.0 | 230 | 230 | 210 | 0.91 | 0.91 |
| 520 (Comp. Ex.) | 3.0 | 230 | 230 | 210 | 0.91 | 0.91 |
| 521 (Comp. Ex.) | 5.0 | 230 | 230 | 250 | 1.09 | 1.09 |
| 522 (Comp. Ex.) | 7.0 | 230 | 230 | 250 | 1.09 | 1.09 |
| 523 (Comp. Ex.) | 9.0 | 230 | 230 | 250 | 1.09 | 1.09 |
| 524 (Comp. Ex.) | 12.0 | 230 | 230 | 250 | 1.09 | 1.09 |

*1.70 g/m$^2$ (per one side) in the coating weight of gelatin is the coating weight of gelatin in the emulsion layer (the coating weight of gelatin in the emulsion layer of photographic material 504 is 1.40 g/m$^2$)

TABLE 10

| Photographic material | Sensitivity Processing [I] | Sensitivity Processing [II] | Drying characteristics | Roller marks | Residual color |
|---|---|---|---|---|---|
| 501 (Comp. Ex.) | 110 | 100 | C | A | bad |
| 502 (Comp. Ex.) | 120 | 110 | D~C | A | bad |
| 503 (Comp. Ex.) | 130 | 120 | D | A | good |
| 504 (Comp. Ex.) | 140 | 130 | C | D | good |
| 505 (Invention) | 140 | 130 | C | A | good |
| 506 (Invention) | 160 | 150 | C | A | good |
| 507 (Invention) | 180 | 170 | C | A | good |
| 508 (Invention) | 200 | 190 | C | A | good |
| 509 (Invention) | 220 | 210 | C | A | good |
| 510 (Invention) | 140 | 130 | C | A | good |
| 511 (Invention) | 160 | 150 | C | A | good |
| 512 (Invention) | 180 | 170 | C | A | good |
| 513 (Invention) | 200 | 190 | C | A | good |
| 514 (Invention) | 220 | 210 | C | A | good |
| 515 (Invention) | 140 | 130 | C | A | good |
| 516 (Invention) | 160 | 150 | C | A | good |
| 517 (Invention) | 180 | 170 | C | A | good |
| 518 (Invention) | 200 | 190 | C | A | good |
| 519 (Invention) | 220 | 210 | C | A | good |
| 520 (Comp. Ex.) | 130 | 120 | D | A | good |

TABLE 10-continued

| Photographic material | Sensitivity Processing [I] | Sensitivity Processing [II] | Drying characteristics | Roller marks | Residual color |
|---|---|---|---|---|---|
| 521 (Comp. Ex.) | 140 | 130 | D | A | good |
| 522 (Comp. Ex.) | 150 | 140 | D | A | good |
| 523 (Comp. Ex.) | 170 | 160 | D | A | good |
| 524 (Comp. Ex.) | 190 | 180 | D | A | good |

It can be seen from Tables 9 and 10 that when the coating weight of gelatin is 2.7 g/m$^2$ (Photographic Materials 501 to 503), drying characteristics as well as residual color can not be satisfied.

In Photographic Material 504, the coating weight of gelatin is 2.4 g/m$^2$, and drying characteristics and residual color can be satisfied, but roller marks become worse.

On the other hand, when the polymers of the present invention are used, the requirements of drying characteristics, roller marks and residual color can be satisfied. It will be found that when tabular grains having an aspect ratio of not lower than 3.0, sensitivity can be greatly increased.

Further, it will be found that when polyacrylic acid is used, satisfactory drying characteristics can not be obtained. Even with tabular grains having an aspect ratio of not lower than 3.0, sensitivity is inferior in comparison to the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support thereon at least one silver halide emulsion layer and at least one hydrophilic colloid layer containing at least one carboxyl group-containing polymer (having a carboxyl group-containing monomer unit content of at least 20 mol %, but excluding polyacrylic acid) on the same side of the support as the emulsion layer, said polymer having been dissolved in water and added to said hydrophilic colloid layer, wherein the swelling ratio of all the hydrophilic colloid layers on the carboxyl group-containing polymer-containing layer side of the support is 200% or more in distilled water and wherein silver halide grains in at least one silver halide emulsion layer are tabular grains having an aspect ratio of not lower than 3.0, the carboxyl group-containing polymer is represented by the following general formula (I):

$$-(A)_x-(B)_y- \quad (I)$$

wherein A represents a polymerized unit derived from at lest one monomer represented by the following general formula (II), and B represents a unit derived from at least one ethylenically unsaturated monomer copolymerizable with A; X represents 20 to 80 mol %; and y represents 20 to 80 mol %:

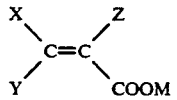

(II)

wherein X, Y and Z each represents a hydrogen atom, a substituted or unsubstituted alkyl group having 1 to 8 carbon atoms, —COOM, —$COOR_1$, —$CONR_2R_3$ or a substituted or unsubstituted phenyl group provided that at least one of X, Y and Z is a substituted or unsubstituted alkyl group having 1 to 8 carbon atoms, —$COOR_1$, —$CONR_2R_3$ or a substituted or unsubstituted phenyl group; $R_1$ represents a substituted or unsubstituted alkyl group having 1 to 18 carbon atoms, a substituted or unsubstituted aryl group having 6 to 18 carbon atoms or a substituted or unsubstituted aralkyl group having 7 to 12 carbon atoms; $R_2$ represents a hydrogen atom, a substituted or unsubstituted alkyl group having 1 to 4 carbon atoms, a substituted or unsubstituted phenyl group or a substituted or unsubstituted aralkyl group having 7 to 10 carbon atoms; $R_3$ represents a hydrogen atom, $R_2$ or —$(R_4$—CONH-$)_w$—$R_4$—$COR_5$; $R_4$ represents an aliphatic or aromatic bivalent group having 1 to 12 carbon atoms; $R_5$ represents OM or —$NR_2R_3$; M represents a hydrogen atom or a cation; and W represents an integer of 0 to 6, and the carboxyl group-containing polymer contains a polymerized unit derived from methacrylic acid in an amount of from 20 to 80 mol %.

2. A silver photographic material as in claim 1, wherein the ratio of the swelling ratio at the time of the completion of the rinsing stage to the swelling ratio at the time of the completion of the development stage is not higher than 1.0 when processing is carried out by the sequential steps of development for 8 seconds, fixing for 7 seconds and rinsing for 7 seconds by using a developing solution containing substantially no hardening agent and a fixing solution containing substantially no hardening agent.

3. A silver halide photographic material as in claim 1, wherein the ratio of the swelling ratio at the time of the completion of the rinsing stage to the swelling ratio in distilled water is not higher than 1.0 when processing is carried out by the sequential steps of development for 8 seconds, fixing for 7 seconds and rinsing for 7 seconds by using a developing solution containing substantially no hardening agent and a fixing solution containing substantially no hardening agent.

4. A silver halide photographic material as in claim 2, wherein the material has been subject to a Dry to Dry processing time of 60 seconds or less in the processing of the silver halide photographic material.

5. A silver halide photographic material as in claim 3, wherein the material has been subject to a Dry to Dry processing time of 60 seconds or less in the processing of the silver halide photographic material.

6. A silver halide photographic material comprising a support having thereon at least one silver halide emulsion layer and at least one hydrophilic colloid layer containing at least one carboxyl group-containing polymer (having a carboxyl group-containing monomer unit content of at least 20 mol %, but excluding polyacrylic acid), said polymer being dissolved in water and added to said hydrophilic colloid layer, on at least one silver halide emulsion layer-coated side thereof, wherein the swelling ratio of all the hydrophilic colloid layers on the carboxyl group-containing polymer-containing layer side of the support is 200% or more in distilled water and wherein the swollen thickness of all the hydrophilic colloid layers at the time of the completion of the rinsing stage is not more than 8 μm when said silver halide photographic material is processed, the carboxyl group-containing polymer is represented by the following general formula (I):

$$-(A)_x-(B)_y- \quad (I)$$

wherein A represents a polymerized unit derived from at lest one monomer represented by the following general formula (II), and B represents a unit derived from at least one ethylenically unsaturated monomer copolymerizable with A; x represents 20 to 80 mol %; and y represents 20 to 80 mol %:

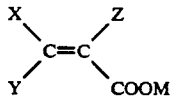

(II)

wherein X, Y and Z each represents a hydrogen atom, a substituted or unsubstituted alkyl group having 1 to 8 carbon atoms, —COOM, —$COOR_1$, —$CONR_2R_3$ or a substituted or unsubstituted phenyl group provided that at least one of X, Y and Z is a substituted or unsubstituted alkyl group having 1 to 8 carbon atoms, —$COOR_1$, —$CONR_2R_3$ or a substituted or unsubstituted phenyl group; $R_1$ represents a substituted or unsubstituted alkyl group having 1 to 18 carbon atoms, a substituted or unsubstituted aryl group having 6 to 18 carbon atoms or a substituted or unsubstituted aralkyl group having 7 to 12 carbon atoms; $R_2$ represents a hydrogen atom, a substituted or unsubstituted alkyl group having 1 to 4 carbon atoms, a substituted or unsubstituted phenyl group or a substituted or unsubstituted aralkyl group having 7 to 10 carbon atoms; $R_3$ represents a hydrogen atom, $R_2$ or —($R_4$—CONH-)$_w$—$R_4$—$COR_5$; $R_4$ represents an aliphatic or aromatic bivalent group having 1 to 12 carbon atoms; $R_5$ represents OM or —$NR_2R_3$; M represents a hydrogen atom or a cation; and W represents an integer of 0 to 6, and the carboxyl group-containing polymer contains a polymerized unit derived from methacrylic acid in an amount of from 20 to 80 mol %.

7. A silver photographic material as in claim 6, wherein the ratio of the swelling ratio at the time of the completion of the rinsing stage to the swelling ratio at the time of the completion of the development stage is not higher than 1.0 when processing is carried out by the sequential steps of development for 8 seconds, fixing for 7 seconds and rinsing for 7 seconds by using a developing solution containing substantially no hardening agent and a fixing solution containing substantially no hardening agent.

8. A silver halide photographic material as in claim 6, wherein the ratio of the swelling ratio at the time of the completion of the rinsing stage to the swelling ratio in distilled water is not higher than 1.0 when processing is carried out by the sequential steps of development for 8 seconds, fixing for 7 seconds and rinsing for 7 seconds by using a developing solution containing substantially no hardening agent and a fixing solution containing substantially no hardening agent.

9. A silver halide photographic material as in claim 7, wherein the material has been subject to a Dry to Dry processing time of 60 seconds or less in the processing of the silver halide photographic material.

10. A silver halide photographic material as in claim 8, wherein the material has been subject to a Dry to Dry processing time of 60 seconds or less in the processing of the silver halide photographic material.

11. A silver halide photographic material comprising a support having thereon at least one silver halide emulsion layer and at least one hydrophilic colloid layer containing at least one carboxyl group-containing polymer (having a carboxyl group-containing monomer unit content of at least 20 mol %, but excluding polyacrylic acid) on the same side of the support as the emulsion layer, said polymer having been dissolved in water and added to said hydrophilic colloid layer, and wherein the composition of the material is such that drying is carried out within a residence time of 7.5 second or less in a drying stage when said silver halide photographic material is processed in a roller conveying type automatic processor, the carboxyl group-containing polymer is represented by the following general formula (I):

$$-(A)_x-(B)_y- \quad \text{(I)}$$

wherein A represents a polymerized unit derived from at lest one monomer represented by the following general formula (II), and B represents a unit derived from at least one ethylenically unsaturated monomer copolymerizable with A; x represents 20 to 80 mol %; and y represents 20 to 80 mol %;

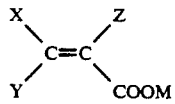

(II)

wherein X, Y and Z each represents a hydrogen atom, a substituted or substituted alkyl group having 1 to 8 carbon atoms; —COOM, —$COOM_1$, —$CONR_2R_3$ or a substituted or unsubstituted phenyl group provided that at least one of X, Y and Z is a substituted or unsubstituted alkyl group having 1 to 8 carbon atoms, —$COOR_1$, —$CONR_2R_3$ or a substituted or unsubstituted phenyl group; $R_1$ represents a substituted or unsubstituted alkyl group having 1 to 18 carbon atoms, a substituted or unsubstituted aryl group having 6 to 18 carbon atoms or a substituted or unsubstituted aralkyl group having 7 to 12 carbon atoms; $R_2$ represents a hydrogen atom, a substituted or unsubstituted alkyl group having 1 to 4 carbon atoms, a substituted or unsubstituted phenyl group or a substituted or unsubstituted aralkyl group having 7 to 10 carbon atoms; $R_3$ represents a hydrogen atom, $R_2$ or —($R_4$—CONH-)$_w$—$R_4$—$COR_5$; $R_4$ represents an aliphatic or aromatic bivalent group having 1 to 12 carbon atoms; $R_5$ represents OM or —$NR_2R_3$; M represents a hydrogen atom or a cation; and W represents an integer of 0 to 6, and the carboxyl group-containing polymer contains a polymerized unit derived from methacrylic acid in an amount of from 20 to 80 mol %.

12. A silver photographic material as in claim 11, wherein the ratio of the swelling ratio at the time of the completion of the rinsing stage to the swelling ratio at the time of the completion of the development stage is not higher than 1.0 when processing is carried out by the sequential steps of development for 8 seconds, fixing for 7 seconds and rinsing for 7 seconds by using a developing solution containing substantially no hardening agent and a fixing solution containing substantially no hardening agent.

13. A silver halide photographic material as in claim 11, wherein the ratio of the swelling ratio at the time of the completion of the rinsing stage to the swelling ratio in distilled water is not higher than 1.0 when processing is carried out by the sequential steps of development for 8 seconds, fixing for 7 seconds and rinsing for 7 seconds by using a developing solution containing substantially no hardening agent and a fixing solution containing substantially no hardening agent.

14. A silver halide photographic material as in claim 12, wherein the material has been subject to a Dry to Dry processing time of 60 seconds or less in the processing of the silver halide photographic material.

15. A silver halide photographic material as in claim 13, wherein the material has been subject to a Dry to Dry processing time of 60 seconds or less in the processing of the silver halide photographic material.

* * * * *